US005595252A

United States Patent [19]

O'Hanlon

[11] Patent Number: 5,595,252

[45] Date of Patent: Jan. 21, 1997

[54] FIXED-CUTTER DRILL BIT ASSEMBLY AND METHOD

[75] Inventor: Thomas A. O'Hanlon, Tacoma, Wash.

[73] Assignee: Flowdril Corporation, Kent, Wash.

[21] Appl. No.: 282,075

[22] Filed: Jul. 28, 1994

[51] Int. Cl.[6] ..... E21B 10/46

[52] U.S. Cl. ..... 175/57; 175/393; 175/429; 175/431

[58] Field of Search ..... 175/431, 429, 175/428, 393, 57

[56] References Cited

U.S. PATENT DOCUMENTS

| | | | |
|---|---|---|---|
| 3,111,179 | 11/1963 | Albers | 239/591 |
| 3,235,018 | 2/1966 | Troeppl | 175/413 |
| 3,419,220 | 12/1968 | Goodwin et al. | 239/591 |
| 3,542,142 | 11/1970 | Hasiba | 175/67 |
| 3,838,742 | 10/1974 | Juvkam-Wold | 175/380 |
| 4,073,354 | 2/1978 | Rowley et al. | 175/430 |
| 4,174,759 | 11/1979 | Arbuckle | 175/67 |
| 4,253,533 | 3/1981 | Baker, III | 175/329 |
| 4,262,757 | 4/1981 | Johnson, Jr. | 175/67 |
| 4,351,401 | 9/1982 | Fielder | 175/428 |
| 4,391,339 | 7/1983 | Johnson, Jr. | 175/393 |
| 4,397,361 | 8/1983 | Langford, Jr. | 175/307 |
| 4,543,427 | 8/1985 | Wang et al. | 175/67 |
| 4,558,753 | 12/1985 | Barr | 175/329 |
| 4,718,505 | 1/1988 | Fuller | 175/428 |
| 4,790,394 | 12/1988 | Dickinson et al. | 175/61 |
| 4,823,892 | 4/1989 | Fuller | 175/329 |
| 4,889,017 | 12/1989 | Fuller et al. | 175/428 X |
| 4,981,184 | 1/1991 | Knowlton et al. | 175/429 |
| 4,991,670 | 2/1991 | Fuller | 175/428 |
| 5,004,056 | 4/1991 | Goikhman et al. | 175/293 |
| 5,027,912 | 7/1991 | Juergens | 175/429 |
| 5,186,268 | 2/1993 | Clegg | 175/431 X |
| 5,238,075 | 8/1993 | Keith et al. | 175/431 |
| 5,265,685 | 11/1993 | Keith et al. | 175/431 |

FOREIGN PATENT DOCUMENTS

| | | | |
|---|---|---|---|
| 1439195 | 11/1988 | U.S.S.R. | 175/429 |
| 2086451 | 5/1982 | United Kingdom | 175/431 |

*Primary Examiner*—Hoang C. Dang

*Attorney, Agent, or Firm*—Robert B. Hughes; Hughes, Multer & Schacht

[57] ABSTRACT

A drill bit assembly comprising a plurality of cutter units, with each cutter unit comprising a circumferentially forward, relatively blunt positioning cutter, followed by a fixed cutter having a relatively sharp cutting edge, with the cutting edge of the following cutter being positioned a predetermined distance below an operating position of the positioning cutter. Thus, the cutting depth of the following cutter is controlled by the positioning cutter locating the drill bit assembly against the hole end wall from which material is being cut. Also, additional fixed cutters can be provided in circumferential alignment in said cutting units, and liquid jet cutters can be used in combination with said cutting units.

57 Claims, 19 Drawing Sheets

FIXED-CUTTER DRILL BIT ASSEMBLY AND METHOD

BACKGROUND OF THE INVENTION

A. Field of the Invention

This invention relates to drilling apparatus and methods, and more particularly to such drilling apparatus and methods used for drilling or coring deep holes in subsurface earth formations, such as drilling holes in rock in connection with the fossil fuel industry.

B. Background Art

Drill bits incorporating fixed cutting surfaces (drag bits) are widely used in the fossil fuel industries for drilling soft to medium strength rock. The bit is rotated and pushed against the rock by the drill stem, causing the cutting surfaces (cutters) on the bit to dig into the rock and scrape rock fragments (cuttings) from the work face. A fluid (water, air, foam or drilling "mud") is pumped through the drill stem, and then out and around the drill bit to flush cuttings away from the work face so that the cutters can continually contact fresh rock. The fluid also acts to cool the cutters and bit body, removing heat generated by friction from scraping the rock and heat emitted from the rock formation.

Cutters used for drag bits are constructed of extremely hard materials such as tungsten carbide, natural diamonds and man-made polycrystalline diamond (PDC & TSD). These cutters are wear resistant but expensive to manufacture. Drag bits mounting these cutters can advance rapidly through rocks with low to medium strength and abrasiveness and survive adequately to achieve economic life. However, many rock formations frequently encountered are strong and abrasive and cause rapid wear or breakage of the best drag bit cutters.

As rock strength increases, higher axial loads are required on the drill bit to force the cutters to penetrate into the work face. This increases the rate of frictional heating and accelerates heat induced fracture and degradation of the cutter edges. Abrasive rock particles also accelerate frictional heating and abrasive wear on the cutters. The wear flats grow, requiring even higher axial forces to push the cutter into the rock. The result is a "snowball" effect of increasing frictional heating and wear. Soon the wear flats become so large that the maximum axial force available is insufficient to force the cutters far enough into the rock to enable an economic advance rate for the drag bit.

A second cause of cutter failure is rapid load variations on the cutter edges due to the elastic failure mode of some strong or brittle rock types. Many softer rocks fail in a plastic mode with relatively constant forces on the cutter edges, which scrape away uniform furrows of rock particles similar to a plow shearing through moist topsoil. Brittle rocks fail in irregular fragments, causing rapid build-up and release of forces on the cutter edges. If the cut depth is too deep, the force surges can be large enough to fracture the cutters. The rapid intermittent cyclic loading also causes fatigue of the cutter edges and can excite vibration of the drill bit or initiate eccentric bit rotation, further accelerating cutter wear and failure.

A third cause of cutter failure is inconsistent rock hardness. This often occurs in thinly bedded sedimentary rocks or rocks interspersed with nodules or crystals of harder material. The depth of cut that will cause forces sufficiently high to break a cutter is much less for hard brittle rock than for soft rock. The axial force on the drill bit causes the cutters to bite further into soft rock than into hard. If a hard spot is suddenly encountered, the cut depth at that instant may be too great, causing cutters to fracture.

Prior attempts to reduce cutter wear and failure have included:

a. improving cutter materials to increase wear resistance;

b. modifying individual cutter shape and geometry to reduce forces on the cutter;

c. modifying bit body geometry to improve cutter chip flushing and cooling;

d. adding extra cutters near the bit perimeters (gauge) where wear is most severe;

e. improving bit body materials to strengthen cutter attachment;

f. modifying bit body design to minimize the possibility of eccentric rotation; and g. mounting poses (studs) behind the cutters to reduce impact loading.

These changes have greatly improved drag bits, allowing them to be used economically in rocks with medium strength and abrasiveness instead of only in soft rocks as was the case previously. However, they still cannot economically drill hard abrasive rock. To the best knowledge of the applicant, at present drag bits account for less than one third of total bit usage.

Accordingly these rock formations are typically drilled with roller cone bits that use rotating conical wheels holding teeth that crush and gouge the rock. Roller cone bits are more durable in hard rock but advance more slowly than drag bits, increasing the time, and hence the time dependent portion of costs, to complete the drilling project.

It has also been known in the drilling industry to use ultra high pressure liquid jets (as high as 35,000 PSI or higher, sometimes in conjunction with small abrasive particles entrained therein) in conjunction with roller cone bits to assist the drilling process. The discharge nozzles are located adjacent to the operating surface of the bit to discharge the liquid jets into the end wall surface of the drill hole and weaken the rock material. To maximize the effect of the ultra high pressure jets, it is desirable that these be placed as closely as possible to the rock formations on which the liquid jet impinges. However, with the jet discharge orifices being placed more closely to the rock surface that is being cut, there is a greater chance of damage to the nozzles. This could occur, for example, by the jet nozzle contacting a protrusion or irregularity in the rock, or by a fragment of rock. Another problem is "splash back", in that material (e.g. rock fragments) may be caused to rebound from the end wall surface and strike the jet nozzle assembly and damage the same.

A search of the patent literature has disclosed patents, these being the following:

U.S. Pat. No. 5,004,056 (Goikhman et al) discloses a percussion-rotary drilling tool where there are drilling elements 5 and 6, mounted in a casing 8 at the drilling location. The outer rock crushing elements 9 are provided with spring loaded locating elements 16, formed with a retaining element 17 having a spring 18. Patentability seems to be predicated primarily on this feature. As the rock crushing elements 5 and 6 wear out and thus decrease in height, the reaction of the bottom surface of the borehole on the support elements 22 which in turn is mounted to the casing 2 causes the casing 2 to move upwards. It is stated in column 6, line 49 that during upward movement of the casing 2, the rock crushing elements are displaced toward the periphery of the tools which ensures a constant diameter of the tool, and in effect a constant diameter of the borehole 15.

There is a group of four related patents, naming John Fuller as the inventor or a co-inventor, these being the following: U.S. Pat. No. 4,718,505; U.S. Pat. No. 4,823,892; U.S. Pat. Nos. 4,889,017 and 4,991,670. Insofar as these patents relevant to the concepts of the present invention, all of these have essentially the same basic disclosure. For convenience, reference will be made to the latest patent to issue. This discusses the problem of deep drilling where the drill passes through a comparatively soft formation and strikes a significantly harder formation or possibly hits some hard occlusions within the soft formation. The cutting elements in the drill bit may be subjected to very rapid wear. One prior art solution was to provide adjacent the rearward side of the cutting element a body of material impregnated with natural diamond. In this instance where the cutting element experiences rapid wear or fracture, the diamond impregnated support on which the element is mounted takes over the abrading action of the cutting element and permits continued use of the drill bit. It is stated that one disadvantage of this is that the diamond impregnated support generates a great deal of heat and the resultant high temperature tends to cause rapid deterioration. This patent shows an arrangement where there are a plurality of cutting elements 15 and spaced a short distance rearwardly of these cutting elements 15 are "abrading elements 16". For example, as shown in FIG. 3, each cutting element 15 has front thin hard facing layer 17 of polycrystalline diamond bonded to a thickening backing layer. Each abrasion element 16 comprises a cylindrical stud and it is coated with particles 21 of natural or synthetic diamond or other super hard material.

U.S. Pat. No. 4,790,394 (Dickinson et al) relates generally to the use of high velocity cutting jets to bore a hole. There are various arrangements, and one is to provide a whirling mass of pressurized fluid in a chamber and discharge it through a nozzle in the form of a high velocity cutting jet having a shape of a thin conical shell.

U.S. Pat. No. 4,558,753 (Barr) relates to cutting elements for a drill, and these cutting elements have different back rake angles. One function of this invention is to have two sets of cutting members, one set having its cutting faces closer to the end operating face of the bit body than the cutting faces of the other set. The back rake angles of the cutting faces of the innermost set are more negative than the rake angles of the outer cutting faces. As the bit operates, the cutters with the less negative rake angles will contain and cut the more soft formation, this being accomplished rather rapidly. However, at such time as it enters into a hard rock formation, the outermost set of cutters (i.e. the more forward set) will quickly chip or break away so that the remaining cutters having a more negative rake angles can continue the drilling.

U.S. Pat. No. 4,543,427 (Wang et al) discloses a drilling apparatus which provides an abrasive containing fluid jet. There are mechanical cutting means which break off the material between the grooves which are formed by the high pressure jets, so as to form a completed borehole.

U.S. Pat. No. 4,397,361 (Langford, Jr.) shows a rotary drill bit where there is a number of protective protruding elements that extend beyond the cutters. As the bit is moving down the borehole or otherwise being handled, these protectors, prevent damage to the cutting elements. During operation, these protective members are worn away, leaving the cutting elements to engage the ground surface and function during the boring operation.

U.S. Pat. No. 4,262,757 and U.S. Pat. No. 4,391,339 (both of which issued to Johnson, Jr. and three other inventors) are two related patents (one being a continuation of the other) having identical drawings and descriptions. These relate to a drill bit for deep hole drilling combining mechanical cutting and plurality of "cavitating liquid jet nozzles" to assist in the drilling action.

U.S. Pat. No. 4,351,401 (Fielder) discloses a concept for earth boring drill bits. In the bit section, there is a coating of a hard wear resistant material and cutters are mounted in the sockets in this material. Penetration of the cutters is controlled by diamonds that are embedded in the hard material adjacent to the gauge of the bit and extending around the gauge of the bit. These engage the surface of the material being cut so as to control the depth of the cut.

U.S. Pat. No. 4,253,533 (Baker, III.) shows a drill bit where there are a number of diamond insert cutter blanks at the face of the bit. There are two wear pads positioned on diametrically opposed portions of the operating face of the drill bit. These wear pads serve to channel the flow of drilling mud emanating from fluid passages formed in the face of the drill bit.

U.S. Pat. No. 4,174,759 (Arbuckle) shows a rotary drill bit where there are mechanical rock breaking wheels. Also, a high pressure fluid jet cuts grooves in the bore bottom.

U.S. Pat. No. 4,073,354 (Rowley et al) shows an earth boring drill bit. The subject matter of this patent appears to be closely related to a later issued patent discussed above (U.S. Pat. No. 4,351,401) which is assigned to the same assignee (Christensen, Inc.), and having one common inventor. This patent shows a particular type of cutting element.

U.S. Pat. No. 3,838,742 (Juvkam-Wold) discloses a drill in which high pressure abrasive jets cut a series of concentric grooves in the bore bottom. There are wedge-like elements that break up the material between the grooves.

U.S. Pat. No. 3,542,142 (Hasiba) shows a drill bit where there are some high velocity fluid jets discharged from the working face of the drill bit to form concentric circular grooves. Loading elements ride in the grooves to break up the material.

U.S. Pat. No. 3,419,220 (Goodwin et al) shows an abrasive jet nozzle. The end of the nozzle has a tapered configuration, and this nozzle is used to discharge a fluid abrasive slurry. The inner material which comes in contact with the slurry is described as being more abrasive resistant.

U.S. Pat. No. 3,235,018 (Troeppl) shows what is called an "Earth Auger Construction". This shows a particular arrangement of teeth spaced radially outwardly from one another. The two diametrically opposed sets of teeth appear to travel in different grooves, and one set appears to be spaced somewhat lower than the other.

U.S. Pat. No. 3,111,179 (Albers) shows a nozzle element for an earth boring jet drill. The nozzle element is made of a shell 21 that is formed in a casing 22. The shell is of abrasive resistant material such as tungsten carbide and the casing is a less expensive material that lends support and strength to the nozzle.

SUMMARY OF THE INVENTION

The present invention comprises a rotary drill bit assembly and also a method of using the same. One of the advantages of the present invention is that it is able to extend the effective life of the drill bit assembly, particularly under circumstances where the drill bit assembly is encountering occlusions or material in the earth formation of differing hardness. Also the present invention provides effective drilling through the earth formation.

The bit assembly of the present invention has a longitudinal axis of rotation. There is a drill bit housing having an upper end adapted to be connected to a drill stem means and a lower end at which the housing has an operating surface. The housing is configured and arranged for rotation about the longitudinal axis.

There is at least one cutter unit mounted at the operating surface along a circumferential cutting path having a circumferential axis at a predetermined radial distance from the longitudinal axis. As the drill bit assembly rotates about the longitudinal axis, the cutter unit travels along the circumferential cutting path in a forward direction around the longitudinal axis.

The cutter unit comprises:

i. a forwardly located lead positioning cutter having a lower relatively hard positioning portion with a downwardly facing relatively blunt contact surface. The contact surface is located axially at a lower positioning location to engage material at the drill hole end wall at the circumferential path;

ii. a trailing cutter having a relatively sharp cutting edge portion which is positioned at the circumferential axis rearwardly of the leading positioning cutter at an axial location operationally lower than the contact surface of the positioning cutter, in a manner to be positioned and configured to cut into the drill hole end wall as the drill assembly advances into the drill hole.

Thus, in operation, the lead positioning cutter engages the drill hole end wall to locate the drill assembly axially relative to the end wall of the drill hole, and thus locate the cutting depth of the trailing cutter axially relative to the circumferential path.

In the preferred form, the positioning cutter has a relatively hard material removal surface portion of the contact surface extending forwardly and upwardly from a lowermost positioning surface portion of the contact surface in a manner to be able to engage and remove at least some material from the drill hole end wall, with the material removal surface portion desirably being relatively blunt. Also, in the preferred form, the contact surface of the positioning cutter has side surface portions extending upwardly and laterally from the lower positioning surface portion, relative to the circumferential cutting surface, and preferably defining with the positioning surface portion a downwardly facing generally convexly curved contact surface. In the preferred form, the convexly curved surface has a material engaging surface portion between about 40 to 180 degrees of curvature and a radius of curvature of between about 0.15 or 0.2 to 0.51 inches, or about one fifth to one half inch, with the preferred ranges being between about 80 to 140 degrees of curvature and the radius of curvature being between about 0.25 to 0.35 inches, or one quarter to one third inch.

The cutting assembly desirably comprises a plurality of the cutter units, each of which is positioned at a respective circumferential cutting path with the cutting paths each having a respective radial distance from the longitudinal axis. Adjacent cutting paths of radially spaced cutting units are spaced radially from one another by a spacing distance no greater than a radially aligned width dimension of the convexly curved contact surface of the positioning cutter.

In a preferred configuration the radially aligned width dimension of the contact surface is between about 60 to 100 percent of the spacing distance of the cutting paths of the radially adjacent cutting units, and more desirably between about 80 to 100 percent. The positioning surface portion of the side surface portions of the contact surface comprise a contact surface area having a contact width dimension measured radially from the outside edges of the side surface portions of the contact surface. The trailing cutter is desirably a fixed cutter having a forwardly facing fixed relatively sharp cutting edge portion having a lower middle cutting edge portion and side cutting edge portions, with the cutting edge having a cutting width dimension. The contact width dimension is desirably greater than the cutting width dimension in a manner that the side surface portions of the contact surface extend laterally beyond a kerf cut by the cutting edge of the trailing cutter. Preferably, the contact width dimension is at least about one tenth greater than the cutting width dimension, and also in the preferred form no greater than one quarter times greater than the cutting width dimension.

The cutter unit travels axially in a generally helical path having a helical axis, as the drill bit assembly, in operation, rotates and travels downwardly as it removes material from the end wall of the drill hole.

The assembly has an operational depth dimension reference line, measured at angularly spaced locations around a circumferential axis of the helical path relative to axial distance from the helical path.

The assembly also has an axial depth dimension line measured relative to locations on the drill bit assembly along a plane that is fixedly located at an axial location on the drill bit assembly and perpendicular to the longitudinal axis.

The trailing cutter has a lowermost cutting edge portion that is lower, relative to the operational depth dimension line, than a lowermost portion of the contact surface of the positioning cutter. In another embodiment, the lowermost cutting edge portion has an axial location at least as low as the lowermost portion of the contact surface of the positioning cutter, relative to the axial depth dimension reference line, and in another arrangement lower than the lowermost portion of the contact surface of the positioning cutter, relative to the axial depth dimension reference line. A preferred range is that the lowermost cutting edge portion is at least one twentieth of an inch below the lowermost portion of the contact surface, relative to the axial depth dimension reference line, and no more than about one and one half tenths of an inch below the lowermost portion of the contact surface, relative to the axial depth dimension reference line.

Also, in a preferred embodiment, the cutter unit comprises a secondary trailing cutter which has a cutting edge and is positioned on said circumferential axis rearwardly of the trailing cutter, which is then a primary cutter. Desirably, there is a plurality of such cutter units positioned at the operating surface at different circumferential axes.

In one arrangement, the secondary trailing cutter has a lowermost cutting edge portion which is at a depth location no higher than the lowermost cutting edge portion of the trailing cutter, relative to the operational depth dimension reference line of the trailing cutter. In another form, the lowermost edge portion of the secondary trailing cutter is at a lower depth dimension relative to the operational depth dimension line of the lowermost edge of the trailing cutter. In yet another arrangement, the lowermost cutting edge portion of the secondary trailing cutter is at approximately the same depth location, relative to the axial depth dimension reference line as the lowermost cutting edge portion of the trailing cutter, and the secondary trailing cutter is circumferentially closer to the trailing cutter measured in a forward direction of travel to said trailing cutter, in comparison to a circumferential distance measured in a rearward direction circumferentially to said trailing cutter.

In yet another embodiment, there is at least one additional secondary trailing cutter which has a cutting edge and which is positioned on the circumferential axis rearwardly of the secondary trailing cutter. The additional secondary trailing cutter is, in different embodiments, at a depth location, relative to the operational depth dimension line of the secondary trailing cutter, lower than the lowermost edge of the secondary trailing cutter. In another arrangement, the lowermost cutting edge portion of the additional secondary trailing cutter is at least as low as approximately the depth location as the lowermost cutting edge portion of the secondary trailing cutter, relative to the axial depth dimension reference line.

In another embodiment, the drill bit assembly comprises a liquid jet cutter positioned on the circumferential axis between the positioning cutter and the trailing cutter. The liquid jet cutter is arranged to direct a high velocity liquid jet downwardly against the end wall at a location forwardly of the trailing cutter. In the preferred arrangement the lowermost surface portion of a lower surface of the liquid jet cutter is positioned at a depth location above the lowermost portion of the contact surface of the positioning cutter with reference to the axial depth dimension reference line.

The lower surface of the liquid jet cutter is desirably made of a wear resistant material, and this lower surface slants away from a liquid jet discharge nozzle of the cutter at an upward slant. Thus, splashback resulting from the liquid jet is deflected away from the liquid discharge nozzle. Desirably, there is a plurality of the cutter units mounted at the operating surface of the drill bit housing, and the operating surface of the drill bit housing is positioned above the lowermost portions of the positioning cutter, the liquid jet cutter, and the trailing cutter, in a manner to provide a liquid flow passage means between the drill hole end wall and the operating surface, so that liquid flow from the liquid jet cutters is able to pass from the operating surface and around the drill bit housing.

In yet another embodiment, the drill bit assembly has a cutting unit where there is a forwardly located lead primary cutter having a cutting edge with a lowermost cutting edge portion located axially at a lower location at the circumferential path, and a trailing secondary cutter having a cutting edge with a lowermost cutting edge portion. The secondary cutter is positioned at the circumferential axis rearwardly of the lead primary cutter. The trailing secondary cutter is positioned relative to the lead cutter so that the distance of the lowermost edge portion of the lead cutter is at a depth location less than one half the axial distance that the cutter unit travels in one revolution. Thus, the lead cutter cuts to a greater material depth along said circumferential path than the trailing cutter. As described above, relative to other embodiments, the trailing cutter has its lowermost edge at a depth dimension no higher than the operational depth dimension of the lowermost portion of the leading cutter, and other embodiments at about the same axial location relative to the lowermost edge of the lead cutter. Also, the trailing cutter is circumferentially closer to the lead cutter, measured in a forward direction of travel.

In another embodiment, there is an additional trailing secondary cutter, and this is disposed at a different depth dimensions in different embodiments, relative to the lead cutter, with respect to both the operational depth dimension line and the axial depth dimension reference line, similarly to the embodiments described above.

In a further embodiment, there is provided a forwardly located lead primary cutter having a cutting edge and also a trailing secondary cutter having a cutting edge, this being followed by a liquid jet cutter. The lowermost surface portion of the lower surface of the liquid jet cutter is positioned at a depth location above a lowermost portion of the cutting edge portion of the lead positioning cutter, with reference to the operational depth reference line.

In the method of the present invention, a drill bit assembly is provided as described above. In the embodiment where there is a forward lead positioning cutter and a trailing cutter, the method comprises rotating the drill bit assembly with an axially downward force exerted by the drill bit assembly against the end wall. This is done in a manner that the lead positioning cutter engages the drill hole end wall to locate the drill bit assembly axially relative to the end wall of the drill hole, and thus locate the cutting depth of the trailing cutter axially relative to the circumferential path.

Other features of the method and apparatus of the present invention will become apparent from the following detailed description.

DESCRIPTIONS OF THE PREFERRED EMBODIMENTS

A. Information and Discussion of the Prior Art and Background Information

It is believed that a clearer understanding of the present invention will be obtained by first discussing certain relevant teachings of the prior art, and then describing the embodiments of the present invention. This will be discussed under appropriate sub-headings.

a. General Discussion of a Typical Prior Art Drill Bit Assembly

Figure 1:
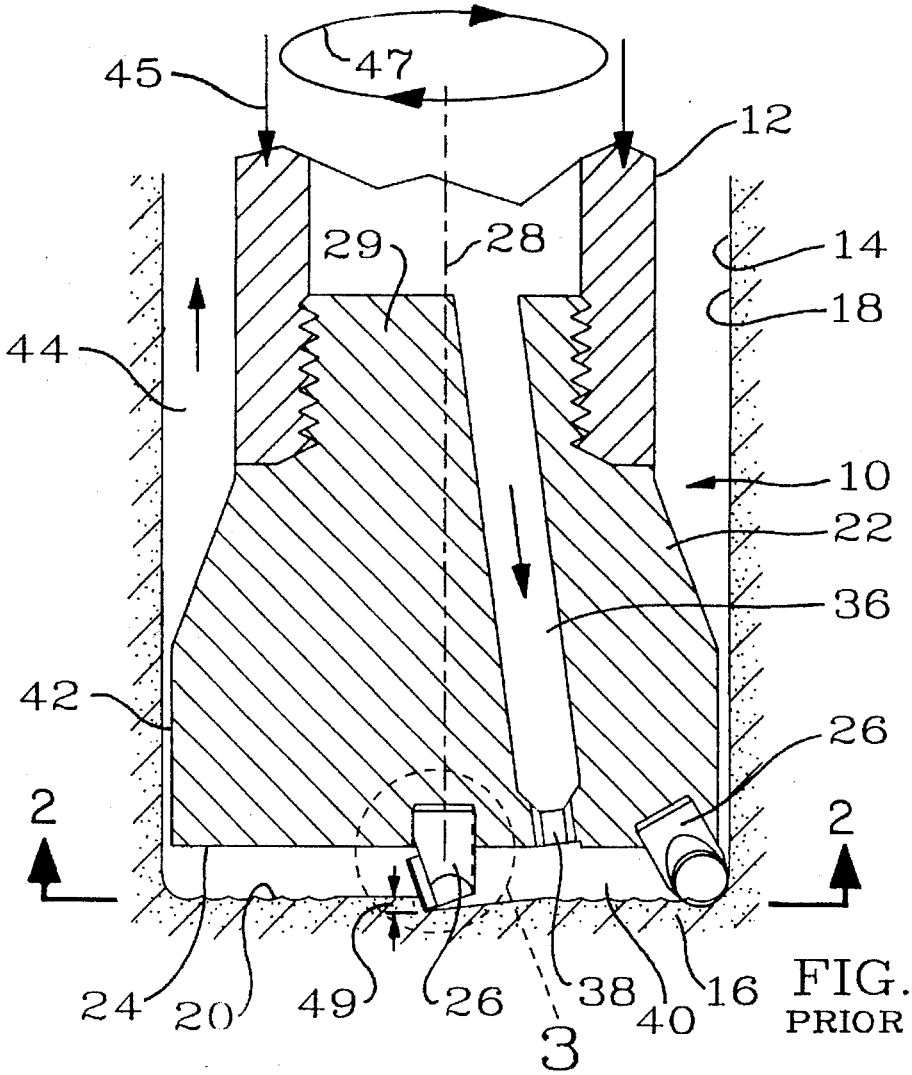
FIG. 1 PRIOR ART
FIG. 1 is a somewhat schematic longitudinal sectional view of a prior art drilling apparatus, comprising a drag bit mounted to a drill stem.
Figure 2:
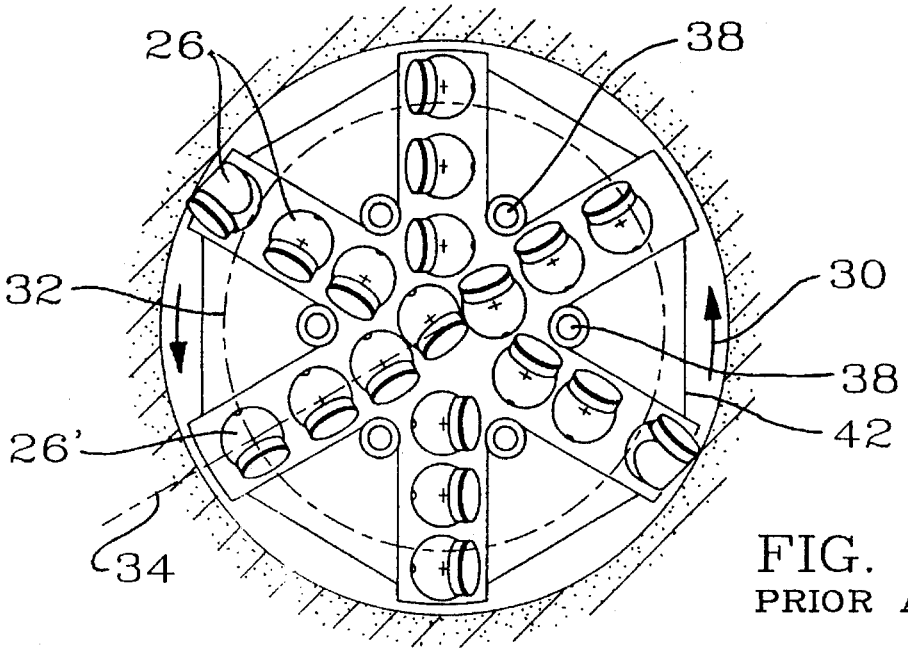
FIG. 2 PRIOR ART
FIG. 2 is an end view, taken along line 2—2 of FIG. 1, looking at the operating surface of the drill bit of FIG. 1.

A common configuration of one type of a drill bit assembly is shown somewhat schematically in FIGS. 1 and 2. This drill bit assembly 10 is shown threadedly mounted to a drill stem 12 and positioned in a drill hole 14 in a below surface earth formation 16. The drill hole 14 has a generally cylindrical sidewall 18 and an end wall or surface 20 at which further material removal takes place.

The drill bit assembly 10 comprises a drill bit housing, shown rather schematically at 22, having an operating end surface 24 at which a plurality of cutters 26 are mounted. For ease of illustration, only two cutters 26 are shown in FIG. 1, it being understood that a greater plurality of such cutters 26 would be provided, as shown in the end view of FIG. 2. (The precise arrangement of the cutters 26 shown in FIG. 2 may or may not exist in the prior art, but this arrangement is believed to be reasonably representative of a prior art cutting assembly. Also placement of the cutters 26 shown in FIG. 2 does not necessarily represent an optimized arrangement of cutters 26. For example, since the outer cutters 26 would normally encounter greater wear, there would likely be more cutters 26 at a more radially outward location. Further, for smaller diameter drill bits, up to approximately 8 inches or so, it is common to place as many cutters at the operating surface 24 as possible, with a main limitation being to accommodate the practical requirements of spacing the cutters 26.)

The drill bit assembly 10, along with the drill stem 12 to which it is fixedly (but removably) mounted has a longitudinal center axis 28 about which the drill bit assembly 10 and the drill stem 12 rotates. For consistency and clarity of description, the drill hole 14 shall be considered at all times as being vertically aligned. Thus, the operating end surface 24 shall be considered to be at the lower end of the drill bit assembly 10, while the connecting portion 29 of the drill housing 22 shall be considered as being at an upper location. It is to be understood, however, that while it is more common for a drill hole to be drilled downwardly into an earth formation, such a drill hole (as shown at 14) could be drilled horizontally, or even in a direction which is (relative to the center of the earth) in an upward direction or upward slant. Even so, the term "downwardly" will still be applied to the direction at which the drill bit assembly 10 moves as it drills against the end wall 20 of the drill hole 14, even if it is parallel to, or away from, the center of the earth.

The term "radially outward" shall denote a direction or location away from the longitudinal center axis 28, while the term "radially inward" shall refer to a direction toward, or in proximity to, the longitudinal axis 28. The term "forward"

shall denote the circular direction of travel of the drill bit assembly 10 and the stem 12. Thus, as shown in FIG. 2, the term "forward" is indicated by the arrows 30. The term "circumferential" or "circumferential axis" shall refer to a circular path or line having as its center the longitudinal center axis 28. For example, with reference to FIG. 2, each of the cutters 26 travels on a related circumferential path. In the following description when a component (e.g. a cutter 26) is discussed relative to a circumferential axis, such as shown at 32 in FIG. 2, the term "lateral" or "laterally spaced" will refer to displacement away from the circumferential axis 32 and along a radially aligned axis, such as shown as 34, either in a radially inward direction or radially outward direction.

It will be noted that the circumferential path of travel or circumferential axis 32 which passes through the center of the cutter 26' does not pass through the center of any of the other cutters 26 shown in FIG. 2. A further examination will show that with the exception of the outermost cutters, each of the cutters 26 shown in FIG. 2 has its own circumferential path of travel, with these paths being spaced one within the other as concentric rings. This is typical of the prior art drill bit assemblies, and this will be discussed later herein, with reference to FIGS. 5–7.

With further reference to FIG. 1, the drill bit housing 22 is shown being formed with a downwardly extending passageway 36 through which a flushing fluid passes to exit at a lower end opening 38 into an operating region 40. This operating region 40 is located between the drill hole end face 20 and the operating end surface 24 of the drill bit housing 22. This flushing liquid is discharged into this operating region 40 to flush cuttings away from the drill hole end wall 20 so that the cutters 26 can continuously contact fresh rock. The fluid also acts to cool the cutters 26 and the housing 22, thus dissipating the heat generated by friction by the scraping of the rock and the heat emitted from the rock formation. As shown in FIG. 2, there is a plurality of such fluid discharge openings 38 (specifically six in FIG. 2), and fluid can be directed to these various openings 38 either from multiple passages, or from a passageway manifold at the lower end of the drill bit housing 22.

The common method of operation of the drill bit assembly 10 is that an axial force 45 is applied through the drill stem 12 to push the drill assembly 10 against the rock surface that is the down hole end wall 20 causing the cutters 26 to penetrate into the end wall 20 to a depth 49. At the same time rotational force (torque) 47 is applied through the drill stem 12 causing the cutters 26 to move in respective circular cutting paths to remove the rock as rock cuttings. At the same time, as indicated above, the flushing fluid passing downwardly through the openings 38 into the operating region 40 moves upwardly around the outside surface 42 of the drill housing 22 and upwardly through the annular passageway 44 between the drill stem 12 and the down hole sidewall 18. the depth 49 of the circular cutting paths will normally increase if the axial force 45 increases or if the hardness of the end wall rock 16 decreases.

b. The Cutting Action of a Prior Art Drill Bit in a Rock Formation

Figure 3:
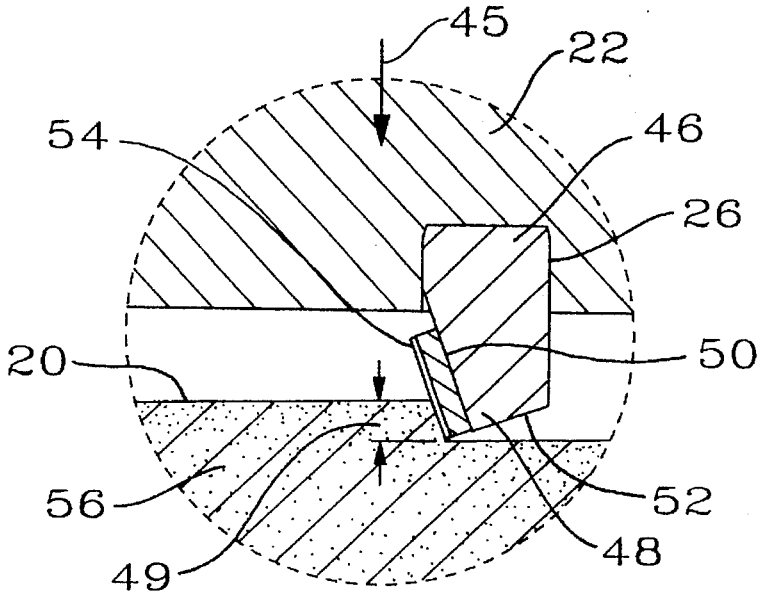
FIG. 3 PRIOR ART
FIG. 3 is an enlarged sectional view taken at the location circled at 3—3 in FIG. 1, illustrating the action of a single cutter mounted in the drill bit.

With reference to FIG. 3, there is shown a single conventional fixed cutter 26 mounted in the drill bit housing 22. This cutter 26 has a generally cylindrical shape, with a cylindrical mounting portion 46 by which it is mounted in the lower end of the housing 22. The lower end portion 48 of the cutter 26 has the forward lower end portion partially removed to form a flat downwardly extending surface with a slight rearward slant, as indicated at 50. The lower surface 52 rearwardly of the flat surface 50 is rounded. There is provided a very hard disc-shaped layer 54 of cutter material, such as tungsten carbide coated or impregnated with commercial diamonds or the like. The configuration of such a cutter 26 is (or may be) conventional, and will be described in more detail later herein.

Figure 4:
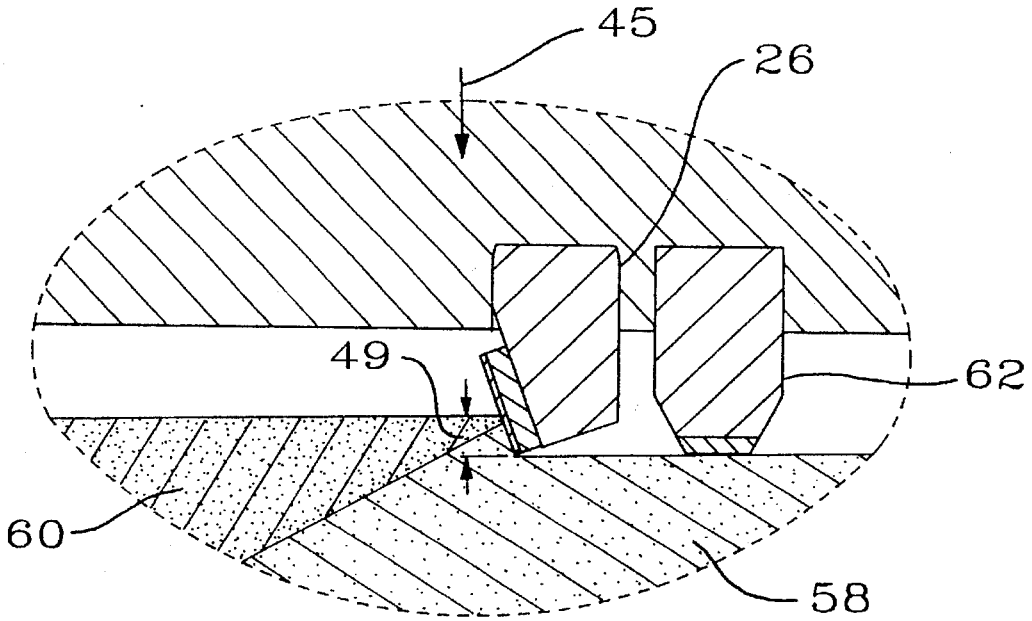
FIG. 4 PRIOR ART
FIG. 4 is a view similar to FIG. 3, showing the single cutter moving through a soft rock formation into some hard rock, and also showing a prior art mount stud being positioned behind the cutter.

As can be seen in FIG. 3, the cutting surface 54 acts against the ground formation 56 adjacent to the end wall 20 to cause the material removal along circular cutting paths to depth 49. As previously indicated, cutting depth 49 will increase or decrease according to the amount of axial force 45 transmitted to cutter 26 through housing 22. The normal mode of operation is to limit axial force 45 to an amount that will result in a cut depth 49 that will not cause the rock 56 to exert too great a resistance to cutter 26 so as to not overload and fracture cutter 26. The situation shown in FIG. 4 is where the cutter 26 is moving through some relatively soft rock 58, so that depth 49 is relatively large, and is about to encounter a formation of relatively hard rock 60. When the cutter 26 is encountering the soft rock 58, it will commonly penetrate into this soft rock 58 to a greater depth, and when it then encounters the hard rock 60 at that greater depth, the resisting force provided by the hard rock 60 is substantially greater than what would normally be encountered. This often causes the cutting surface to fracture and break away, leaving the cutter 26 severely damaged. (The depths of the cuts 49 shown in FIGS. 3 and 4 are somewhat exaggerated for purposes of illustration. Commonly the cutting depth of a single cutter may be no greater than 0.15 inch, or less than that if the rock formation is particularly hard.)

With reference to FIG. 2, if the damage of a number of cutters 26 becomes sufficiently severe, the drill bit 10 cannot properly perform its cutting function. Accordingly, the drill stem 12 must be withdrawn from the hole 14, the bit assembly 10 replaced, with the new drill bit assembly 10 being attached to the lower end of the drill stem, and the drill stem with the new drill bit is then lowered downwardly into the drill hole 14. Not only is there the expense of time and labor of replacing a new drill bit assembly 10, but there is also the cost of the new drill bit assembly 10.

With reference to FIG. 4, one of the prior art solutions to the problem discussed specifically above is to mount studs 62 directly behind the cutters 26 with the intent of reducing high impact loads. However, as illustrated in FIG. 4, such a stud 62 cannot effectively control the cutting depth 49 of the cutter 26 in a situation such as shown in FIG. 4, and hence cannot protect cutter 26 from high resisting forces occurring at the transition from soft rock 58 to hard rock 60.

c. Prior Art Radial Spacing and Axial Location of the Cutters

Figure 5:
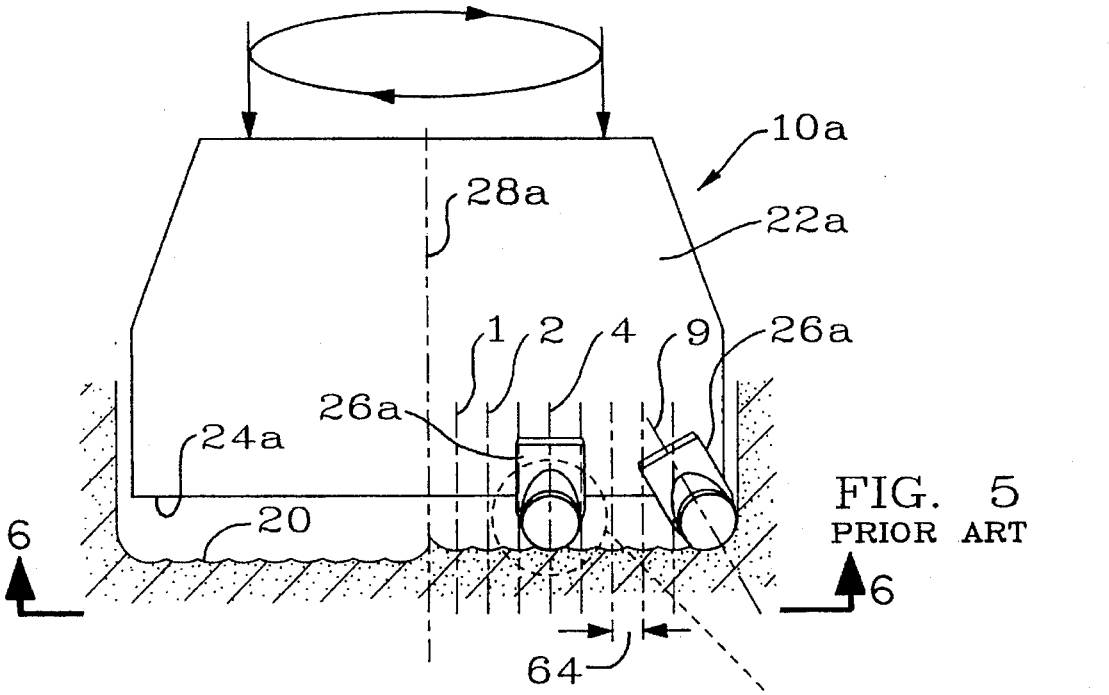
FIG. 5 PRIOR ART
FIG. 5 is a schematic longitudinal sectional view illustrating the radial spacing of cutters as commonly arranged in the prior art, but showing only two cutters for convenience of illustration.
Figure 7:
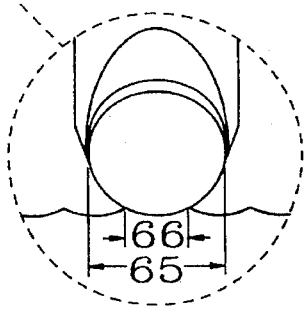
FIG. 7 PRIOR ART
FIG. 7 is an enlarged view, taken at the location circled in FIG. 5, and showing to an enlarged scale one drill bit cutter and the width of the grooves formed in the rock surface relative to the width of the cutter.
Figure 6:
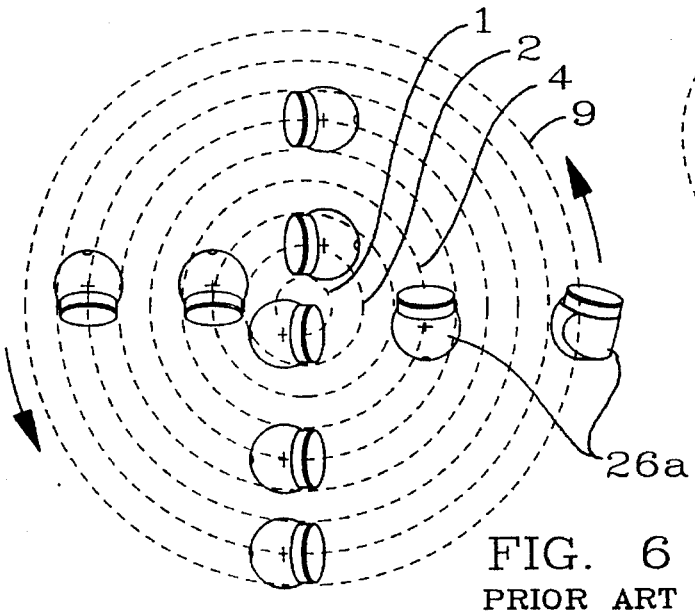
FIG. 6 PRIOR ART
FIG. 6 is an end view of the drill bit of FIG. 5, taken along line 6—6 of FIG. 5.

Reference is made to FIGS. 5 through 7, where there is shown rather schematically a prior art drill bit assembly **10*a*, somewhat the same as that shown in FIGS. 1 and 2, except that for ease of illustration and description, the number of cutters has been reduced to only nine cutters 26*a***.

Generally, the cutters **26*a* are at circumferentially spaced locations along the operating surface 24*a* in a manner that the resisting force exerted by the rock surface 20 is substantially balanced over the operating end surface 24*a* of the drill bit housing 22*a*. Also (and as mentioned earlier herein with reference to FIG. 2), it is conventional practice to have the radial spacing of the various cutters 26*a* (i.e. the distance from the center longitudinal axis 28*a*) be different for the majority of cutters 26*a* so that most cutters follow their own circumferential cutting paths. As illustrated in FIG. 6, there are nine cutters 26*a*, and each of these follows its own circumferential cutting path, (For ease of illustration, in FIG. 5, only two cutters 26***a* are shown, these being located on the circumferential paths 4 and 9, and the location of the other circumferential cutting paths being indicated by the vertical lines in FIG. 5, and the circumferential arcs in FIG. 6, with four of these being numbered, namely those indicated at 1, 2, 4 and 9.)

It has been a conventional practice to have the radial spacing of the individual cutters 26*a* (shown at 64 in FIG. 5) less than half the lateral width dimension of the cutters, indicated at 65 in FIG. 7. Thus, as can be seen in FIGS. 5 and 7, the kerfs or grooves cut by the cutters 26*a* are closely together, with the width 66 of the grooves normally less than half the width 65 of the cutters.

Figure 8:
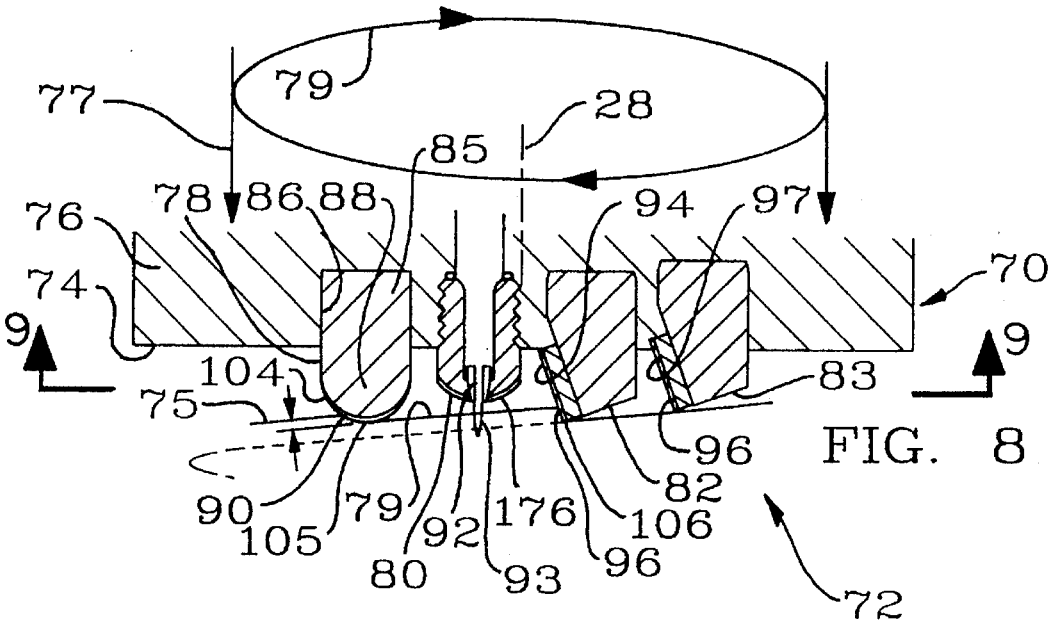
FIG. 8 is a semi-schematic longitudinal sectional view of a drill bit that combines multiple features of the present invention in a single first embodiment, and showing only one cutter unit for ease of illustration.
Figure 9:
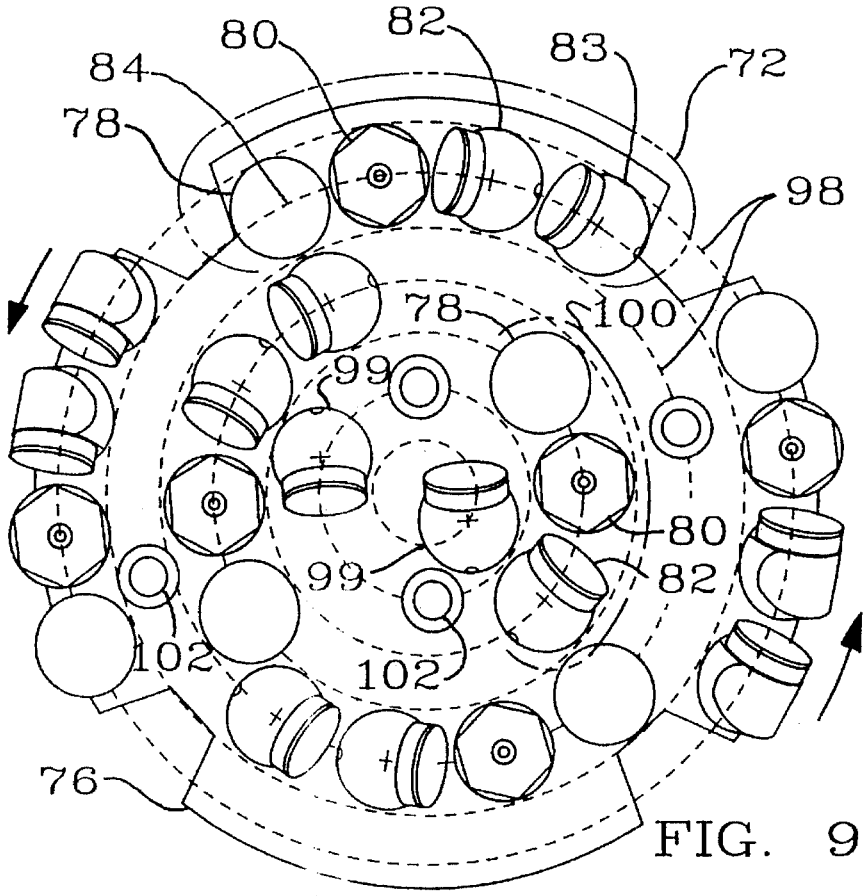
FIG. 9 is an end view looking into the operating face of the drill bit of FIG. 8.

B. A First Embodiment of the Present Invention, in Which Main Principles of the Present Invention Are Combined in a Single Drill Bit Assembly The drill bit assembly 70 of this first embodiment is illustrated in FIGS. 8 and 9. FIG. 8 is a semi-schematic longitudinal sectional view showing (for ease of illustration) only one of a plurality of cutter units 72 which are positioned at various circumferential locations, and also at various radial distances over the operating surface 74 of the drill bit housing 76. (The unit 72 shown in FIG. 8 is the unit 72 seen at the top of FIG. 9.) In this present embodiment, each cutter unit 72 comprises a forward lead positioning cutter 78, an ultra high pressure liquid jet cutter 80 (positioned immediately rearwardly of the positioning cutter 78), and two trailing cutters 82 and 83. These cutters 78, 80, 82 and 83 are aligned on the same circumferential axis 84 and are grouped on an arcuate segment of this circumferential axis 84.

In the description that follows in this section "B", there will simply be a brief description of each of the cutters 78, 80, 82 and 83, and the general manner in which these function in this first embodiment. Then in subsequent sections of this text, there will be more detailed descriptions of these components shown in FIGS. 8 and 9 as separate embodiments.

The lead positioning cutter 78 has an upper cylindrical portion 85 by which it is mounted in a related recess 86 formed in the drill bit housing 76. This cylindrical portion 85 extends downwardly below the operating surface 74 of the housing 76 and terminates in a lower cutting and positioning portion 88 (also called a "contact portion") which has a convex surface which is nearly hemispherical or formed as a lower curved portion of a hemisphere. This lower portion 88 has a relatively blunt cutting surface 90 coated with a very hard and wear resistant surface 90, such as a surface material impregnated or coated with polycrystalline diamond particles. Surface 90 has a forward cutting surface portion 104 curving upwardly and forwardly.

The liquid jet cutter 80 is arranged to receive from the drill stem (not shown) an ultra high pressure cutting liquid, and has a discharge nozzle 92 from which the liquid jet 93 is discharged downwardly against the rock surface. It will be noted that the lowermost surface portion 176 of the liquid jet cutter 80 is positioned a moderate distance upwardly from the lowermost portion 105 of the positioning cutter 78.

Positioned behind the liquid jet cutter 80 is the first fixed cutter 82, followed by the second fixed cutter 83. These fixed cutters 82 and 83 are (or may be) of conventional design and in this embodiment are the same as the cutters 26 described in the prior art drill bit assembly of FIGS. 1 and 2, or the same as the cutters shown in FIGS. 3 through 7. Each of the cutters 82 and 83 has a very hard cutting disc or layer 94 (which is the same as, or similar to the cutting layer 54 of the prior art cutter 26 of FIG. 3), having a rounded lower cutting edge 96. The lowermost portion 106 of cutting edge 96 of cutter 82 is located at distance "S" lower than the lowermost portion 105 of positioning cutter 78. The cutting edges 96 of the cutters 82 and 83 are each at a different vertical position, with the cutting edge 96 of the trailing cutter 83 being slightly higher than the cutting edge 96 of the forward cutter 82. The relatively hard cutting surface material is indicated at 97.

With reference to FIG. 9, it can be seen that there are five cutter units 72 positioned at various circumferential locations around the operating surface 74 of the housing 76, and that each cutter unit 72 has its individual cutters 78, 80, 82 and 83 positioned on an arcuate segment of its own circumferential path. There are seven such circumferential paths, these being designated collectively by the numeral 98. The four more radially outward cutter units 72 have the single positioning cutter 78 the single jet cutter 80 and the two fixed relatively sharp cutters 82 and 83. The two innermost circumferential cutting paths 98 have only a single sharp cutter 99, which can be the same as the cutters 82 and 83. The third innermost cutting unit 100 has a positioning cutter 78, a liquid jet cutter 80 and only a single trailing cutter 82. The reason for the two single innermost cutters 99 and only a total of three cutters in the unit 100 is simply a matter of inadequate space near the center of the operating surface 74 to fit more cutters in. As indicated previously herein, in a smaller diameter drill bit, it is common to place as many cutters over the operating surface of the drill bit housing as is practical, with a greater number being located at the more outward radial locations.

Also, it is to be understood that there are lower end openings 102 to permit the flushing liquid to be discharged into the working area immediately below the operating surface 74 and above the drill hole end wall 75. Four such flush liquid discharge openings are shown in FIG. 9.

To describe generally the operation of this first embodiment of FIGS. 8 and 9, axial force 77 and rotational force 79 are exerted in sufficient amounts to rotate the drill bit assembly 70 about the longitudinal center axis 28 while forcing the positioning cutters 78 against the hole end wall surface 75. This results in the first fixed cutters 82 cutting into the rock at cut depth "s". Cut depth "s" is determined at the time the drill bit assembly 70 is manufactured and is fixed by the distance to which the lowermost portion 106 of the first fixed cutter 82 extends below the lowermost portion 105 of positioning cutter 78. The depth "s" for a drill bit assembly 70 manufactured to drill hard or non-uniform rock will be less than the depth "s" for a drill bit assembly 70 manufactured to drill soft or uniform rock. Drill bit assemblies with various depth "s" dimensions can be inventoried and selected for use according to the rock conditions expected. These conditions are often known in advance due to having previously drilled holes nearby and through the same rock strata where the next drill bit assembly 70 will be used. Depth "s" will typically be 0.04 to 0.08 inches for hard or irregular rock to as much as 0.07 to 0.15 inches for soft or uniform rock. In general, depth "s" will be selected to be as large as possible without risking premature breakage of lead cutter 82.

The function of lead positioning cutter 78 is fourfold. First, its axial placement relative to the first fixed cutter 82 controls the maximum amount of cut depth "s" as described above. If axial force 77 is very low or if the rock is very hard the actual cut depth for the first fixed cutter 82 may be less than the depth "s" controlled by the lead positioning cutter 78, i.e. the lowermost portion 105 of the lead positioning cutter 78 may not be in contact with hole end wall surface 75. Thus, the actual depth of cut will be small and should not cause premature breakage of the first fixed cutter 82. As axial force 77 is increased or the rock becomes softer, the lead positioning cutter 78 will contact the hole end wall surface 75 and the cut depth "s" will be achieved. If axial force 77 is increased further or the rock becomes even softer, the lead positioning cutter 78 will dig into the hole end wall 75 and remove rock at cut depth "d". Depth "d" will vary with the amount of axial force 77 and rock hardness, but the maximum value for depth "s" is constant, protecting the first fixed cutter 82 from premature breakage. This is very important because, in practice, precise control of axial force 77 is difficult and rock hardness can change very frequently and rapidly when drilling through bedded rock formations. Thus use of the lead positioning cutters 78 permits a higher amount of axial force to be used when drilling in variable rock formations, enabling maximum drilling advance rates without fear that depth "s" will suddenly increase to an amount large enough to prematurely break the first fixed cutter 82.

Secondly, the lead positioning cutter 78 sweeps aside any debris or rock cuttings that might wedge under or damage the liquid jet cutter 80. Thirdly, the lead positioning cutter 78 plows over the hole end wall 75 acting to scrape away a thin layer of the end wall that may have become impregnated with fine particles carried in the flushing fluid. This impregnation of particles into the hole end wall is often referred to as the "skin effect" and occurs due to pressure from the drilling fluid forcing tiny particles into the natural pores in the rock. The "skin effect" makes the rock surface effectively tougher and more difficult to cut with a liquid jet 93. Removal of this "skin" layer by the lead positioning cutter 78 creates a freshly exposed rock surface 79 immediately prior to the rock surface 79 being struck by the liquid jet 93 and is beneficial in allowing the liquid jet to cut deeper into the rock than it might otherwise do if no lead positioning cutter 78 were used closely preceding the liquid jet cutter 80. Fourthly, when a situation is encountered in the ground formation shown in FIG. 4 (i.e. when the cutter is moving over soft rock and then encounters a harder rock formation, the upwardly and forwardly slanting leading surface 104 tends to ride up and over the newly encountered hard rock formation.

The drill string to which the drill bit housing 76 is mounted acts as a large spring so that it permits this short increment of upward movement of the drill bit housing 76. However, since the operating surface 90 of the positioning cutter 78 exerts a greater downward force against the rock formation when it is forced upwardly against the resisting force of the drill string, and since the slight upward movement of the drill assembly 76 also lifts the cutters 80, 82 and 83 and the other cutting units 72 upwardly, thus increasing further the downward force exerted by the positioning cutter 78, the surface 90 does cut into the rock surface to a relatively greater extent. However, since the operating surface 90 of the cutter 78 is rather blunt, this cutting action of the cutter 78 is of somewhat limited depth into the rock formation.

This "riding up" of the positioning cutter 78 over the newly encountered hard rock lifts the liquid jet cutter 80 so that it does not come into contact with the newly encountered hard rock formation. Also, this lifts the trailing cutters 82 and 83 so that they are at a lesser depth location when (with further rotation of the drill bit housing 76) the lower cutting edges 96 come into contact with the hard rock formation.

Further, it should be pointed out that the particular placement of the two relatively sharp cutters 82 and 83 in the same circumferential path, positioned closely together relative to the circumferential path, and having certain relative vertical positions, produces a significant benefit. Stated briefly, the cutting edge 96 at the forward cutter 82 cuts more deeply into the rock formation, while the cutting edge 96 of the rear cutter 83 (as shown herein) has little, if any, cutting engagement. The effect of this is that if the forward cutter 82 is fractured or otherwise severely damaged, or if the cutting edge 96 of the forward cutter 82 wears away to a substantial extent, then the rear cutter 83 takes on more of a cutting function along that same circumferential path. Thus, the fracturing, wear or other deterioration of the forward sharp cutter 82 does not destroy the cutting action along the circumferential cutting path 98 of that particular cutting unit 72. This will be discussed in greater detail later herein in the description of other embodiments.

As indicated at the start of this Section "B", this first embodiment of FIGS. 8 and 9 combines several of the main principles or components of the present invention in one embodiment. When combined in the manner shown in FIGS. 8 and 9, it is believed that these various inventive principles or components of the present invention cooperate in a manner that certain aspects of the functions of the present invention are significantly improved. However, it should also be understood that these individual inventive principles or components can operate advantageously apart from their being grouped into this combined embodiment of FIGS. 8 and 9. This will be discussed more fully in the following sections of the text.

C. Controlled Depth Cutting Embodiments (Second and Third Embodiment)

a. Second Embodiment (FIGS. 10 and 11)

Figure 10:
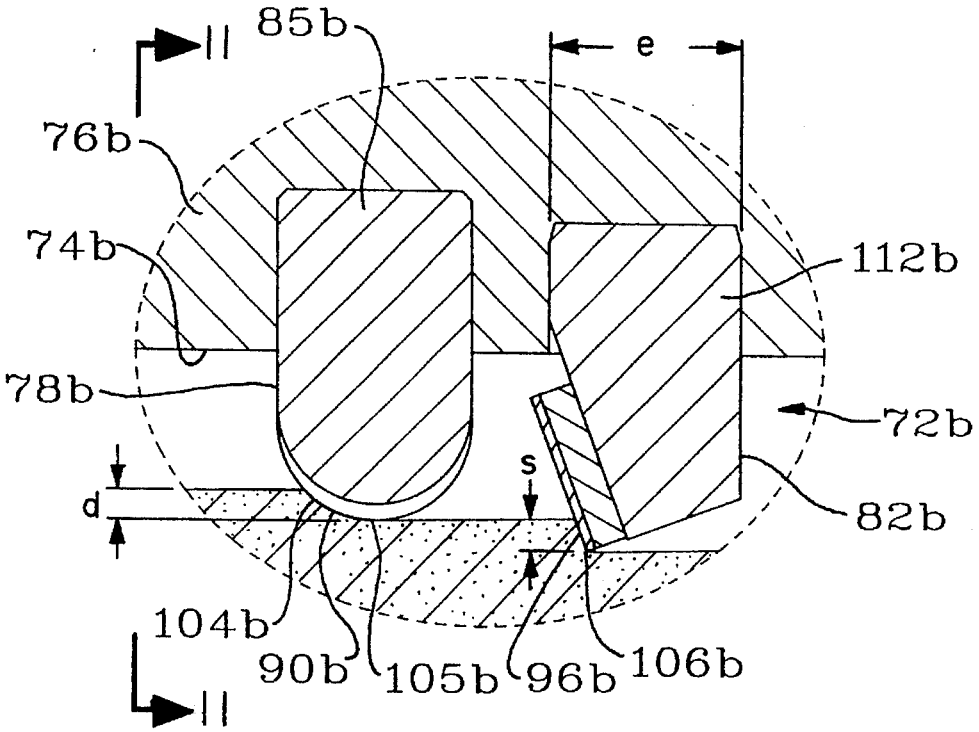
FIG. 10 is a sectional view illustrating a second embodiment of a single positioning cutter and a trailing cutter mounted in a drill bit, engaging a rock formation having soft rock and hard rock.
Figure 11:
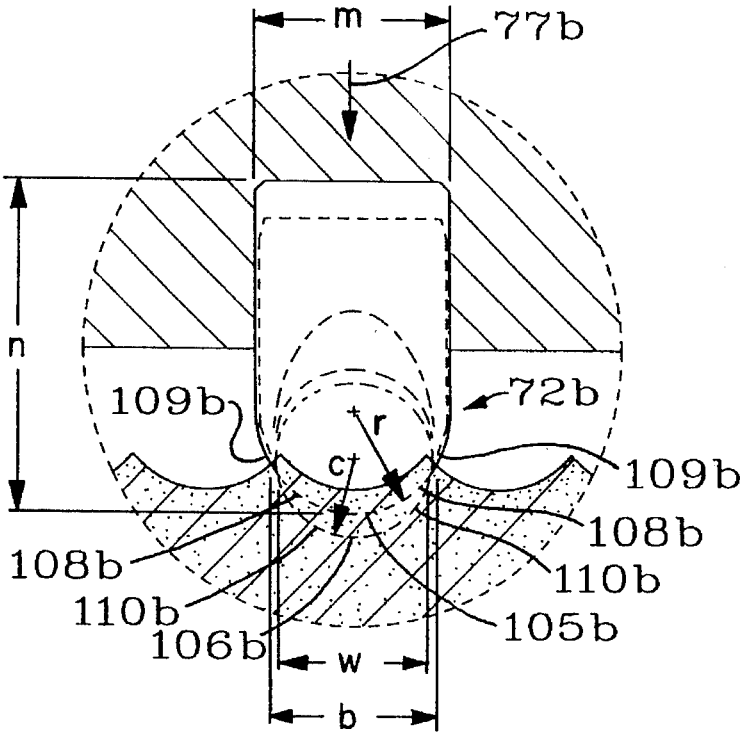
FIG. 11 is a sectional view taken along line 11—11 of FIG. 10.

As indicated above, the second embodiment of the present invention is illustrated in FIGS. 10 and 11, and comprises two of the cutters shown in the first combined embodiment of FIGS. 8 and 9. For clarification, the elements or components of this second embodiment will (when appropriate) be given numerical designations corresponding to those of the first embodiment of FIG. 8 and 9. However, the numerical designation of this second embodiment of FIGS. 10 and 11 will have a "b" suffix to distinguish these as being associated with the second embodiment.

It will be noted that the second embodiment comprises a cutting unit **72*b* having a forward or lead positioning cutter 78*b*, and a single trailing relatively sharp cutter 82*b*, aligned with (relative to the circumferential axis) and positioned behind and closely adjacent to, the forward positioning cutter 78*b***.

The lead positioning cutter **78*b*** can conveniently and more economically be provided as a commercially available, prior art compression or impact cutter, such as those designated as Impax diamond enhanced drilling inserts, Model I-10, manufactured by MegaDiamond.

In general, the main cylindrical mounting portion **85*b* of the positioning cutter 78*b* can have a diameter (indicated at "m") in FIG. 11 between about 0.3 to 1.0 inches, and the overall height dimension of the positioning cutter 78*b* can be between about 0.4 to 3.0 inches (indicated at "n" in FIG. 11). The lower contact surface 90*b* is conveniently rounded so as to have a generally hemispherical shape, or possibly a somewhat flattened hemispherical shape. As seen from a forward direction, the forward sloping lower middle positioning surface portion 104*b* has upwardly and laterally curved side surface portions 108*b*, all of which are part of the contact area of the positioning cutter 78*b*. As can be seen in FIG. 11, as viewed transversely to the circumferential axis of the positioning cutter of 78*b*, the entire contact area would be about 40° to 180°, and the radius of curvature (indicated at "r" in FIG. 11**) would be between about 0.17 to 0.75 inches.

Also as indicated previously, the cutter 82*b* has a relatively sharp cutting edge 96*b*, having a lowermost portion 106*b* and laterally upwardly curved side portions 110*b*. The cutting area of the sharp edge 96*b* can have a contact line extending along a curve between 40° to 180°, and can have a radius of curvature between about 0.17 to 0.75 inch.

As can be seen in FIG. 10, the lowermost portion of the cutting edge 96*b* of the rear cutter 82*b* is relatively sharp and is positioned at a depth greater than the lowermost positioning portion 105*b* of the positioning cutter 78*b*. As indicated previously, the depth of cut indicated as "d" in FIG. 10, for positioning cutter 78*b*, depends largely on the amount of axial force 77*b* and on the character of the rock formation in which the cutter assembly 72*b* is operating. In hard rock, the depth "d" may be near zero. In general, the lowermost edge 106*b* of the sharp cutting edge 96*b* would be below the lowermost portion 105*b* of the contact surface 90*b* of the positioning cutter 78*b* by a distance indicated at "s" in FIG. 10 between about 0.04 to 0.15 inch. Depth "s" will remain relatively constant independent of rock types or changes in rock hardness or changes in axial force 77*b*. As indicated previously, the relatively sharp trailing cutter 82*b* is or may be of conventional design. A prior art cutter 82*b* suitable for use in the present invention could be one designated as GE Stratapax No. 2743 by G.E. Superabrasives, or ½" stud cutter by MegaDiamond.

In general, such a cutter would have an upper mounting portion 112*b* having a diameter (indicated at "e" in FIG. 10) should be between about 0.3 to 1.5 inches. The maximum width dimension of the cutting surface 96*b* (indicated at "w" in FIG. 11) would be approximately no greater than the same as the maximum width dimension of the positioning cutter 78*b* at the contact portion, shown as "b" in FIG. 11.

Desirably the lateral width "b" of the contact surface portion of the positioning cutter 78*b* would be 1/10 to ¼ greater than the lateral width "w" of the full cutting edge 96*b* of the trailing cutter 82*b*. This would cause the furthest lateral portions 109*b* to extend moderately beyond the kerf or groove previously cut by the trailing cutter 82*b*, and in some instances have contact with rock surface portions laterally beyond the cutting area of the sharp cutter (indicated at "w").

In operation, it is to be understood that a plurality of the cutter units 72*b* would be positioned at different locations over the working surface 74*b* of the drill bit housing 76*b*. The particular arrangement of the cutter unit 72*b* of the drill bit assembly will depend to a large extent upon the type of substrate which is expected to be encountered. If the rock formation is relatively soft, then the relative depth spacing (indicated at "s" in FIG. 10) would be made relatively greater so that the depth of cut of the sharp edge 96*b* of the trailing cutter 82*b* would be greater, possibly as great as 0.15 inch. On the other hand, if relatively hard rock or variable soft and hard rock is expected to be encountered, then this depth difference dimension (again indicated at "s" in FIG. 10) could be made possibly as small as 0.04 inch.

Since the drill bit assemblies have to be replaced periodically (e.g. possibly in excess of 30 hours or less than one hundred hours for harder rock types, depending upon the character of the rock and other factors) an optimized drill bit for the rock being encountered could be mounted to the drill string at that time. Within the broader scope of the present invention, conceivably the positioning of the individual cutters 78*b* and 82*b* could be adjusted at the drilling site. However, in view of the somewhat limited life of any drill bit assembly, it may well be more cost effective simply to provide and inventory several arrangements of drill bit assemblies and use these as replacements as needed, as previously described.

The manner in which the cutter unit 72*b* operates has been described previously with reference to the embodiment of FIGS. 8 and 9, so that will not be repeated in any detail at this time. Very briefly, the upwardly and forwardly slanting contact surface portion 104*b* of positioning cutter 78*b* controls the cut depth "s" in softer rock and tends to ride up over the harder rock as it is encountered, and also bears with greater force against that hard rock. This has the effect of lifting the trailing cutter 82*b* to some extent, so that the trailing cutter 82*b* is less likely to fracture when encountering the section of hard rock.

b. Third Embodiment (FIGS. 12 and 13)

Figure 12:
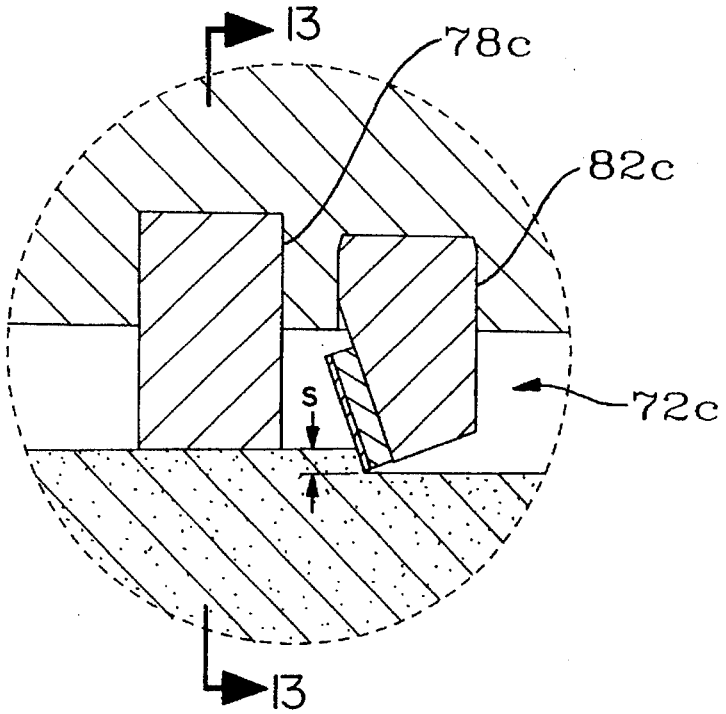
FIG. 12 is a view similar to FIG. 10 showing a third embodiment which is a less preferred version of the embodiment shown in FIG. 10.
Figure 13:
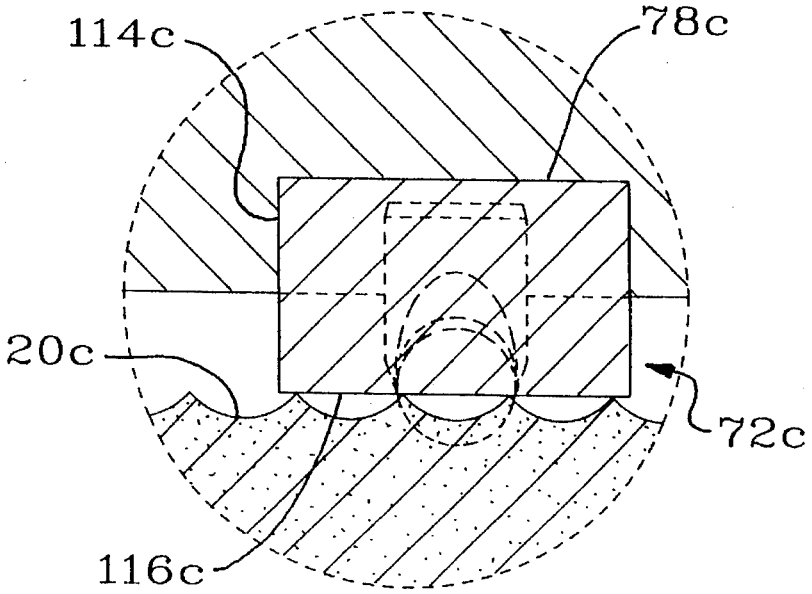
FIG. 13 is a sectional view (similar to FIG. 11) taken along line 13—13 of FIG. 12.

This third embodiment shown in FIGS. 12 and 13 is substantially similar to the first embodiment. Components of this third embodiment which are similar to the prior embodiments will be given like numerical designations, with a "c" suffix distinguishing those of the third embodiment. As in the first embodiment, there is a cutting unit 72*c* with a trailing, relatively sharp cutter 82*c*. However, instead of having the leading positioning cutter 78*b* as in the second embodiment, there is a forward positioning member 78*c* composed of a near resistant material such as tungsten carbide which acts as a passive locating pad, and has little, if any, of a cutting function.

As can be seen in FIG. 13, the locating pad 78*c* has a width dimension substantially greater than the positioning cutter pad 78*b* of the second embodiment. Also, this cutting pad 78*c* has a generally rectangular configuration with lateral edges 114*c* extending well beyond the width of the trailing cutter 82*c*. Also, the positioning member 78*c* has a lower substantially flat planar surface 116*c* which extends over a larger area of the rock at the lower end surface 20*c* of the drill hole.

It can be seen that the positioning pad 78*c* serves a similar positioning function as the positioning cutter 78*b* of the second embodiment. However, the passive locating pad 78*c* performs very little of a material removal function, and essentially rides over the rock surface 20*c*. Thus, while the passive pad 78*c* does serve a function of limiting the depth of cut of the trailing cutter 82*c*, indicated as "s" in FIG. 12, it provides no substantial cutting function when the cutter unit 72*c* is traveling through the rock formation. While the third embodiment of FIGS. 12 and 13 is believed to provide a benefit over and above the prior art, this is, in general, a less preferred embodiment, relative to the second embodiment of FIGS. 10 and 11.

D. Relative Cutter Depth Positioning Embodiments (FIGS. 14 Through 29)

a. Background Information on Helical Spacing Reference Dimensions (FIGS. 14 through 17)

FIGS. 14 through 17 do not represent embodiments of the present invention (nor do these represent any actual prior art embodiments). Rather, these are simplified diagrams which are used to present certain background information given in this sub-section "a" of this Section "D". In this background description, numerical descriptions will be given to correspond to the designations of comparable components described previously, and a "d" suffix will distinguish those components referred to in this section relative to FIGS. 14 through 17.

Figure 14:
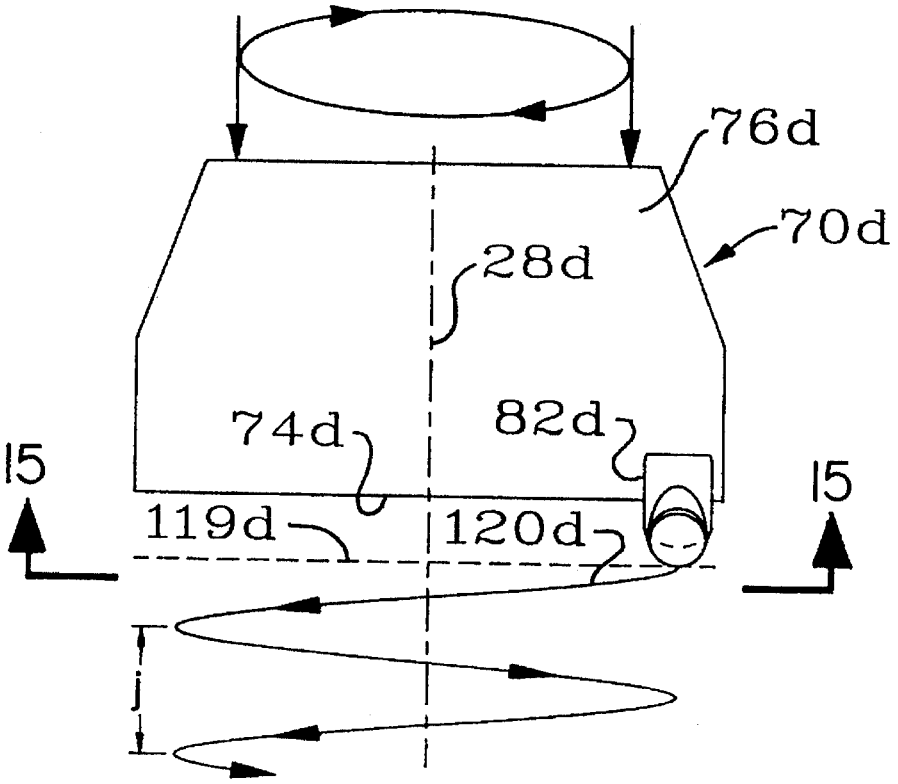
FIG. 14 is a schematic longitudinal sectional view of a drill bit housing and a single cutter, illustrating a helical path of travel of the cutter, this being presented for background information.
Figure 15:
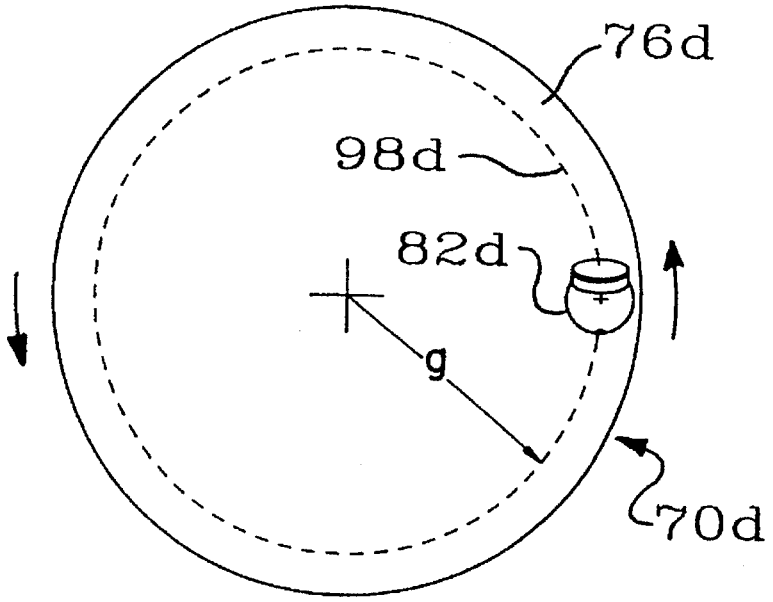
FIG. 15 is an end view taken along line 15—15 of FIG. 14.

In FIGS. 14 and 15, there is shown a single drill bit assembly 70*d* with a housing 76*d*, with a single cutter 82*d* mounted along a circumferential line 98*d* at radius "g" from longitudinal axis 28*d* (see FIG. 15). It can be seen (FIG. 14) that as the housing 76*d* rotates and advances downwardly, the cutter 82*d* follows a helical path 120*d* downwardly into the rock formation. For purposes of illustration, in FIG. 14 the axial rate of travel for each 360° of circumferential travel is greatly exaggerated. The depth of the cutter 82*d* below the operating surface 74*d* is indicated at horizontal plane 119*d*, transverse and perpendicular to the longitudinal center axis 28*d*, and the axial rate of travel for each 360° of rotation of the single cutter 82*h* is indicated at "j" (again the "j" dimension being substantially exaggerated for ease of illustration).

Figure 16:
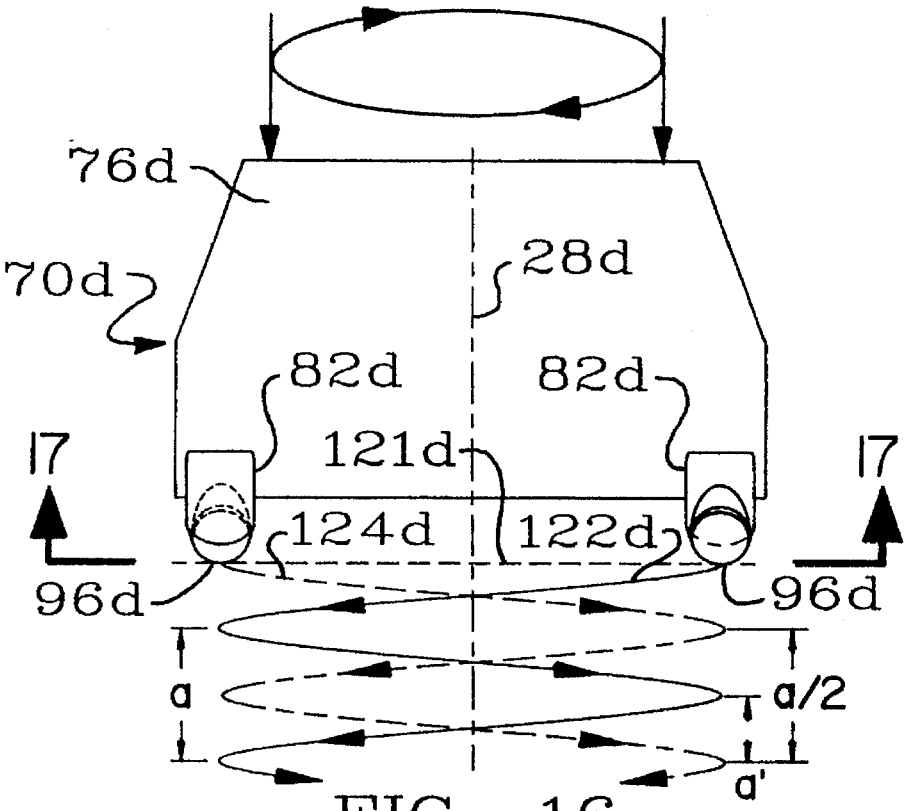
FIG. 16 is a schematic drawing, similar to FIG. 14, showing two cutters, positioned at diametrically opposed locations, and illustrating two separate helical paths of the two cutters, this also being done as a presentation of background information.
Figure 17:
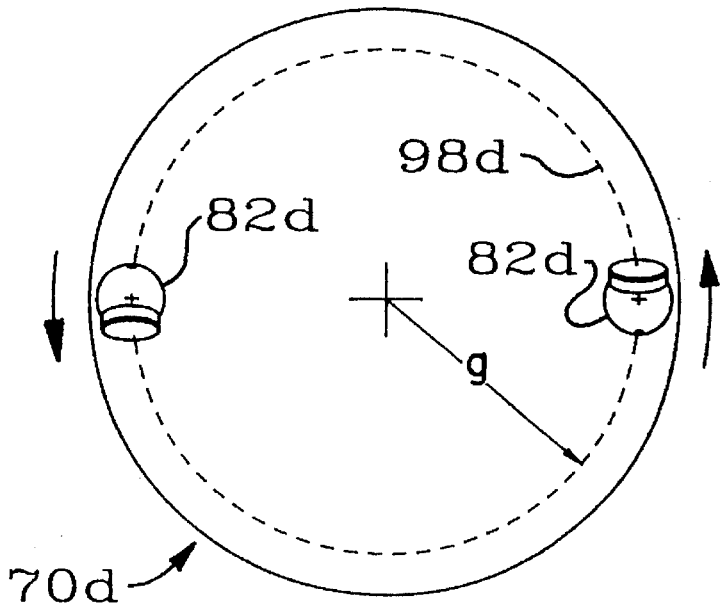
FIG. 17 is an end view taken at line 17—17 of FIG. 16.

Now in turning our attention to FIGS. 16 and 17, it is seen that there are provided two cutters 82*d*, each having a depth dimension indicated at horizontal plane 121*d*. The lower cutting edges 96*d* are at the same depth and horizontal plane 121*d* is transverse and perpendicular to the longitudinal center axis 28*d*. Also, the two cutters 82*d* in FIGS. 16 and 17 are positioned at diametrically opposed locations on the same circumferential axis 98*d* at radius "g" from longitudinal center axis 28*d*.

It can be seen that the circumferential path 122*d* traveled by the cutter 82*d* shown at the right in FIG. 16 has the same axial rate of travel (indicated at "a" in FIG. 16) as the single cutter 82*d* shown in FIG. 14 (as shown at "j"). Also, it can be seen that the cutter 82*d* shown at the left of FIG. 16 travels another helical path 124*d* which also has the same axial rate of travel, indicated at a' in FIG. 16, as the other two paths 120*d* and 122*d*. Each 360° portion of the helical path 124*d* is equally distanced between, and parallel to, the two adjacent 360° portions of the other path 122*d*.

The net effect of this is that while the axial rate of travel of the drill bit 70*d* in FIG. 14 is the same as the axial rate of travel of the drill bit 70*d* shown in FIG. 16, the depth of cut of each of the two cutters 82*d* of FIGS. 16 is half the depth cut (illustrated at the arrows having the designation "a/2"). Also, with the cutters 82*d* in FIG. 16 being 180° apart, the depth of cut for each is equal.

Again, it should be pointed out that the subject matter of FIGS. 14–17 is not an embodiment of the present invention, but are illustrations to help explain certain background information.

b. Fourth Embodiment (FIGS. 18 and 19)

In describing this fourth embodiment, components which are similar to previously described components will be given like numerical designations, with an "e" suffix distinguishing those of this fourth embodiment.

Figure 18:
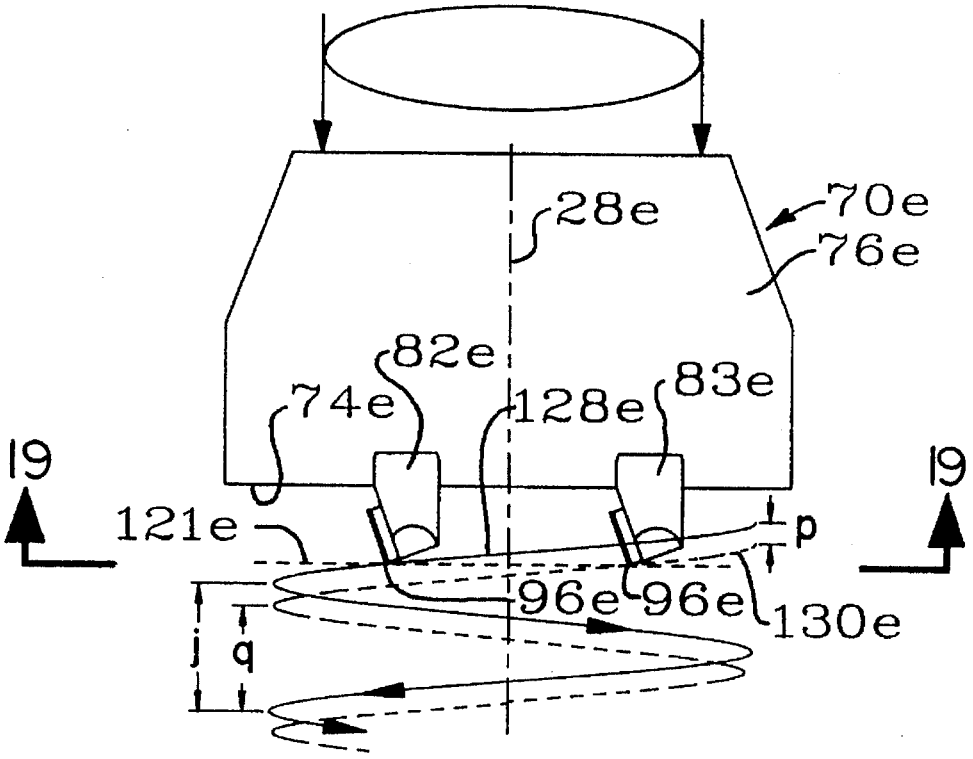
FIG. 18 is a schematic showing of a fourth embodiment of a drill bit of the present invention, illustrating only two cutters, both positioned at the same depth location.
Figure 19:
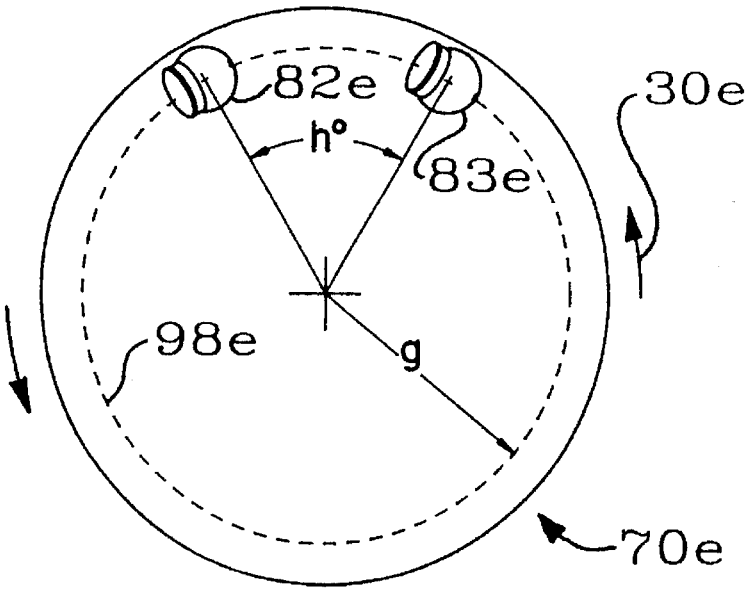
FIG. 19 is an end view taken at line 19—19 of FIG. 18.

With reference to FIGS. 18 and 19, it can be seen that the drill bit assembly 70*e* has a housing 76*e* rotating in the direction indicated at arrow 30*e* about longitudinal axis 28*e* and has mounted at its operating surface 74*e* two cutters 82*e* and 83*e* which are positioned on the same circumferential line or axis 98*e* at radius "g" from longitudinal center axis 28*e*, but are spaced from each only by a circumferential distance of "h°". (It is to be understood, of course, that this is simply a schematic illustration, and that in an actual cutter assembly there would be other cutter pairs at other locations around the circumference of the drill bit housing 76*e* so that the force loads would be balanced. However, only two cutters 82*e* and 83*e* are shown grouped together to illustrate the operating principle of this embodiment.)

With reference to FIG. 18, it can be seen that there is a lead cutter 82*e*, and a trailing cutter 83*e*. The path of the lead cutter 82*e* is indicated at 128*e*, while the path of the trailing cutter 83*e* is indicated at 130*e*. Assuming that the drill bit assembly 70*e* is traveling at a constant axial rate of travel for each 360° of rotation, indicated at "j" in FIG. 18, it can be seen that the depth of cut of the trailing cutter 83*e* (indicated at "p" in FIG. 18) is equal to h° divided by 360° times the total depth of cut (indicated at "j" in FIG. 18). (Again, the angle of the helical paths that travel 128*e* and 130*e* is exaggerated for purposes of illustration.) For example, if "h" degrees equals 60 degrees, then the depth of cut "p" for the trailing cutter 83*e* will equal $^{60}/_{360}$ or $^{1}/_{6}$ (17%) of the total axial rate of travel "j", and hence the depth of cut "q" for the leading cutter 82*e* will be $^{5}/_{6}$ (83%) of the total axial rate of travel "j". For further example, if "h" degrees equals 18 degrees, then the depth of cut "p" for the trailing cutter 83*e* will equal $^{18}/_{360}$ or $^{1}/_{20}$ (5%) of the total axial rate of travel "j", and hence the depth of cut "q" for the leading cutter 82*e* will be $^{19}/_{20}$ (95%) of the total axial rate of travel "j".

Now, let us look at the significance of this relative to the operation of this fourth embodiment of the present invention. It is apparent that the leading cutter 82*e* in FIGS. 18 and 19 would be more susceptible to wear, and also more susceptible to fracturing by reason of traveling at a greater depth through a rock formation as compared to the trailing cutter 83*e*. Thus, the second cutter 83*e* has a better chance of "survival" during a cutting operation.

At this point, for purposes of explanation, let us make a distinction between the "axial relative depth dimension", and the "operating relative depth dimension". In FIG. 18, the bottom cutting edges 96*e* of the two cutters 82*e* and 83*e* are at the same axial relative depth dimension, in that these lie in the same horizontal plane 121*e* transverse to and perpendicular to the longitudinal axis 28*e*.

The operating relative depth dimension is measured relative to helical paths of travel. Thus, relative to the leading cutter 82*e* (FIG. 18), the operating relative depth dimension of trailing cutter 83*e* is measured with regard to the helical path 128*e*. Accordingly, the trailing cutter 83*e* has an operating depth dimension, measured from the helical path 128*e* at the location of the trailing cutter 83*e* to the lowest part of the cutting edge 96*e* of the trailing cutter 83*e* equal to the dimension indicated at "p" in FIG. 18. At the same time, the forward cutter 82*e* has an operating relative depth dimension with reference to the trailing cutter 83*e* which is equal to "q" (FIG. 18).

Now contrast the arrangement shown in FIGS. 18 and 19 with that shown in FIGS. 16 and 17, where the two cutters 82*d* are shown as being diametrically opposed to one another. It is readily apparent that the cutters 82*d* of FIGS. 16 and 17 have the same relative axial depth locations on plane 121*d* and have the same operating relative depth dimensions, with each of these depth dimensions being equal to "a/2". Thus, the chances of "survival" of one or the other of these cutters 82*d* shown in FIGS. 16 and 17 are approximately equal and neither cutter can be identified as "leading" or "trailing". Further, the wear rate of the two cutters 82*e* in FIGS. 16 and 17 would, in general, be approximately the same.

Let us look at the situation where the drill bit assembly is moving through a softer rock formation and thus cutting at a greater depth and then encounters a relatively hard rock formation. With the configurations shown in FIGS. 18 and 19, it can be seen that for a given axial rate of travel, the depth of the cut of the lead cutter 82*e* is at the greater depth of cut, indicated at "q" in FIG. 18, when the hard rock formation is encountered. On the other hand, when the trailing cutter 83*e* would come into engagement with a hard rock formation after traveling through relatively soft rock, the depth of its engagement with the hard rock would be indicated at the smaller depth dimension "p" shown in FIG.

18. Thus, the presence of the forward cutter 82*e* circumferentially adjacent to, and on the same circumferential axis as, the trailing cutter 83*e* enhances the ability of the trailing cutter 83*e* to "survive" in going through rock formations having rock of different hardness. Thus if the leading cutter 82*e* is fractured, the trailing cutter 83*e* would have previously been subjected to less wear and stress, and also would be in a position to function to cut a kerf in the rock formation at the proper depth to function compatibly with the other cutters in the drill bit assembly 70*e*.

At this time, it should be pointed out that one of the advantages of the cutter arrangement in FIGS. 8 and 9 of the first embodiment becomes more evident, relative to the cutters 82 and 83 that are positioned behind the positioning cutter 78. This feature will be discussed more completely later again in connection with the embodiments shown in FIGS. 28 and 29.

c. Fifth Embodiment (FIGS. 20 and 21)

Components of this fifth embodiment which are similar to the components of the prior embodiments will be given like numerical designations, with an "f" suffix distinguishing those of this fifth embodiment.

In this fifth embodiment, there is a drill bit assembly 70*f* with housing 76*f* rotating in the direction indicated by the arrows 30*f* and having six cutters 82*f* and 83*f* mounted at its operating face 74*f*, these being three lead cutters 82*f* with cutting edges 96*f* located at the axial reference plane 121*f* and three trailing cutters 83*f* with cutting edges 96*f* located on the axial reference plane 123*f* with the cutters 82*f* and 83*f* being positioned alternately with one another, and cutters 83*f* being spaced "h" degrees apart from cutters 82*f*. For ease of illustration, only one unit or grouping of two cutters 82*f* and 83*f* are shown in FIG. 20, while six cutters 82*f* and 83*f* are shown in FIG. 21.

Figure 20:
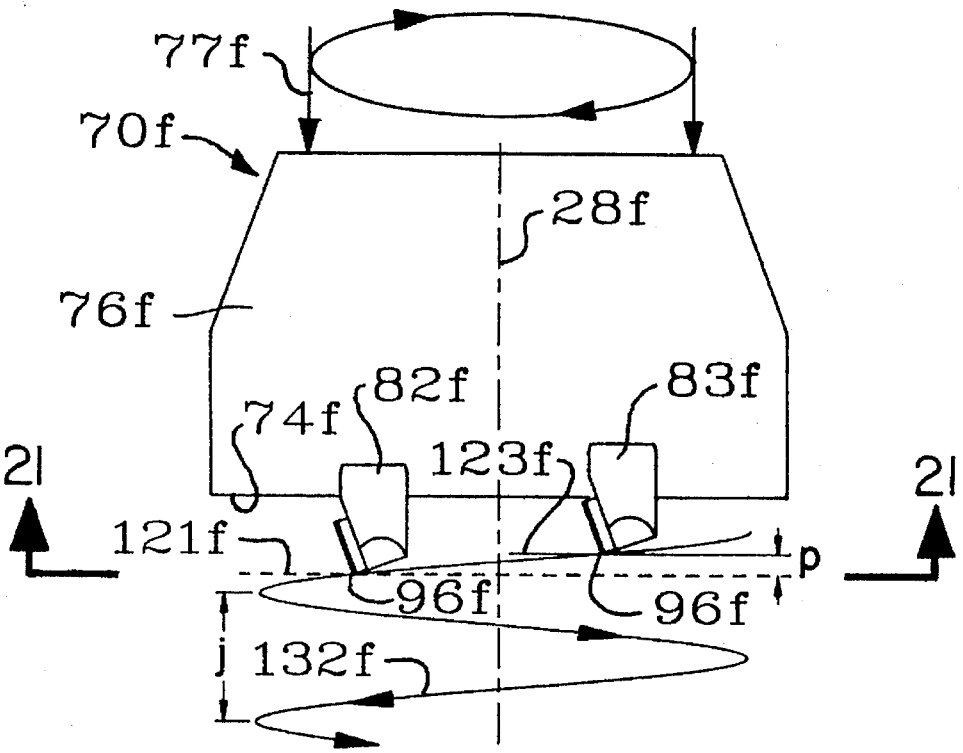
FIG. 20 is a view similar to FIG. 18, illustrating a fifth embodiment of the present invention, and showing for ease of illustration only two of a plurality of cutters mounted to a drill bit housing.
Figure 21:
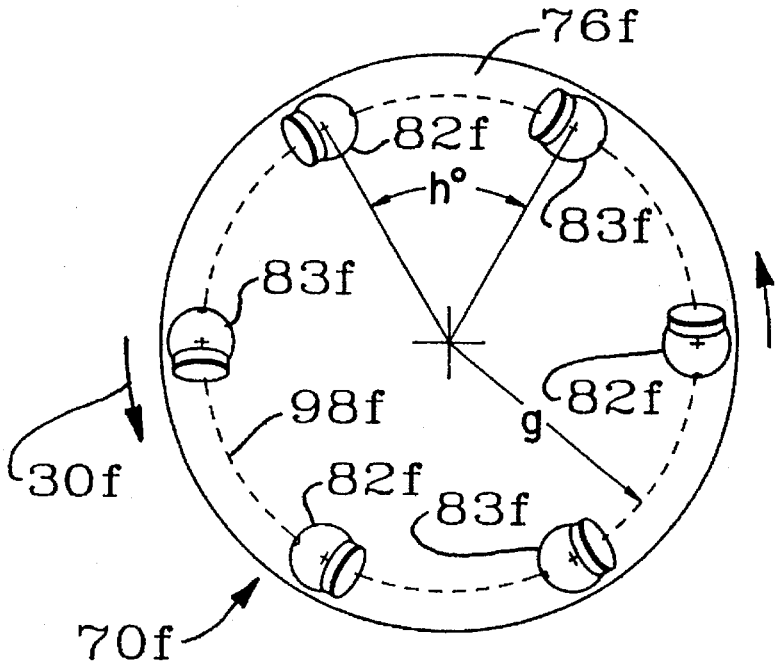
FIG. 21 is an end view taken at line 21—21 of FIG. 20.

It can be seen in FIG. 20 that the lead cutter 82*f* is following a helical path 132*f* with a total axial rate of travel per revolution indicated as "j". The trailing cutter 83*f* is positioned (relative to an actual depth dimension) upwardly of the adjacent leading cutter 82*f* by a distance indicated at "p" of FIG. 20 and hence reference planes 121*f* and 123*f* are separated by the distance "p". However, it will be noted that the lower part of the cutting edge 96*f* of the trailing cutter 83*f* is on the same radial path 98*f* as the lower part of the cutting edge 96*f* of the leading cutter 82*f*. Distance "p" is of the same ratio to distance "j" as is angle "h" to 360°. Thus, in terms of operating relative depth location, it can be seen that the operating depth location of the trailing cutter 83*f* is the same as that of the leading cutter 82*f*.

With reference to FIG. 21, it can be seen that all six cutters 82*f* and 83*f* lie on the same circumferential axis 98*f* at radius "g" from longitudinal center axis 28*f*. In the arrangement shown in FIG. 21, the three cutters 82*f* act as primary cutters, taking more of the brunt of the loads, while the trailing cutters 83*f* act as secondary cutters. In the operating mode shown in FIG. 20, each secondary cutter 83*f* will not engage the rock or be subjected to wear until the immediately adjacent forward cutter 82*f* starts to wear away. Then the cut depth for the trailing cutter 83*f* will be small, and equal to the wear depth of the immediately adjacent forward cutter 82*f*. It should be understood that this analysis is somewhat idealized since the exact rate of travel "j" per revolution axially into the rock formation may not be accurately known in advance and can only be estimated when the bit is manufactured. In practice, the drill bit assembly will be constructed with a predetermined distance "p" calculated from the average axial advance for the rock expected to be encountered.

At this point, attention should be called to a "fringe benefit" of this arrangement shown in FIGS. 20 and 21. Quite commonly, the sharp cutters 82*f* or 83*f* are made with a very sharp cutting edge 96*f*. With the cutting edge 96*f* being very sharp, the cutter 82*f* or 83*f* is more susceptible to damage. Thus, when a new drill bit assembly is just starting to be used, there is generally a "break in" period where the engagement of the cutters is kept shallow by reducing axial thrust 77*f* so that the cutters have time to wear away the sharp cutting edges to some extent. This slight dulling of the sharp cutting edge does not degrade the cutting performance all that much, and it makes the cutter less susceptible to damage when, for example, it comes upon a hard rock formation, since a very sharp edge is more easily fractured.

To relate this to the arrangement shown in FIGS. 20 and 21, the leading cutter 82*f* initially protects the trailing cutter 83*f*. As the leading cutter 82*f* begins to wear away, it exposes the sharp cutting edge 96*f* of the trailing cutter 83*f* more gradually. Thus, even though the drill bit assembly 70*f* is being operated at full capacity to maximize its rate of cutting, the trailing cutters 83*f* are each provided with their own individual "break-in periods". Thus, if the forward cutter 82*f* fractures, then the trailing cutter 83*f* is already "broken in" to function more reliably.

Again, it is to be recognized that the arrangement shown in FIGS. 20 and 21 is rather schematic, and it is evident that this precise grouping and arrangement of cutters would in all likelihood not, by itself, be used in this particular arrangement. However, this embodiment of FIGS. 20 and 21 does show the arrangement of providing the primary and secondary cutters by varying the axial depth location and placing the cutter units 72*f* closer to one another along the operating depth reference line, which in FIG. 20 would be indicated by the helical path 132*f*. Thus, in accordance with the prior explanation of the difference between the axial reference depth location and the operating relative depth location, while the two cutters 82*f* and 83*f* as shown in FIG. 20 are at different axial relative depth locations, they are at the same location relative to the operating relative depth dimension.

It is obvious of course that this principle shown in FIG. 20 and 21, and also that shown in FIGS. 18 and 19 could be combined. For example, the trailing cutter 83*f* could be moved downwardly to some extent so that while still being (relative to axial location) above the cutter 82*f*, it could still be positioned to accomplish a certain amount of cutting of the rock formation by being below the operating relative depth location.

d. Sixth Embodiment (FIGS. 22, 22*a* and 23)

Components of this sixth embodiment which are similar to components described early herein will be given like numerical designations, with a "g" suffix distinguishing those of the sixth embodiment.

Figure 22:
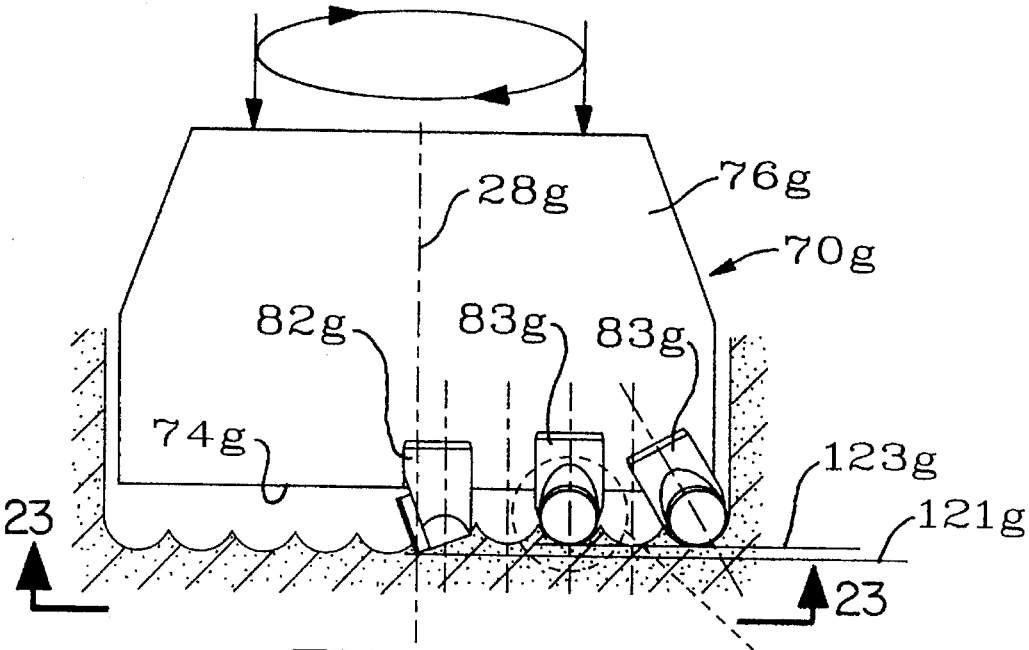
FIG. 22 is a schematic drawing, similar to FIG. 20, showing a sixth embodiment, similar to that shown in FIGS. 20 and 21, where there is a plurality of sets of cutters, with each set being at different radial distances.
Figure 22A:
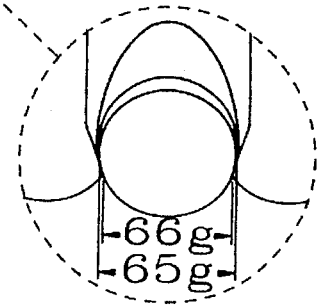
FIG. 22A is an enlarged view taken at the location circled in FIG. 22 showing one drill bit cutter and the width of the cutter relative to the grooves cut into the rock surface.
Figure 23:
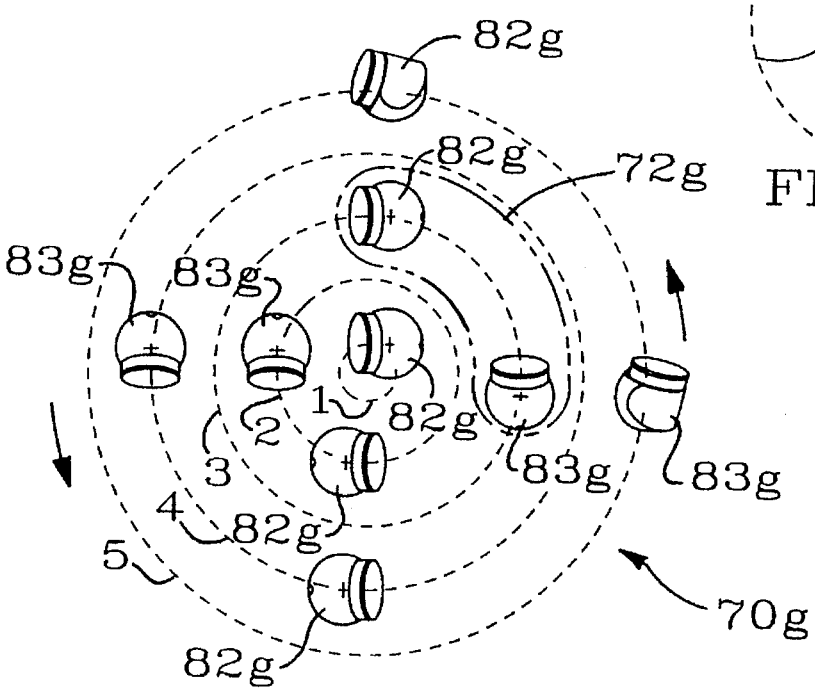
FIG. 23 is an end view taken at line 23—23 of FIG. 22.

For ease of illustration, only one leading cutter 82*g* and two trailing cutters 83*g* are illustrated in FIG. 22, while a full nine cutters are shown in the end view of FIG. 23. For purposes of comparison, attention is directed to FIGS. 5 and 6, which illustrate the prior art practice of spacing all nine cutters at different circumferential locations, with these being positioned circumferentially in a reasonably balanced configuration to distribute the axial forces applied by engagement with the end rock surface. It will become apparent in comparing FIG. 23 with FIG. 6 that there is some similarity in that both are provided with nine cutters, and also that these cutters are spaced in a somewhat symmetrically configuration for more even load distribution across the operating face 74*g* of the cutter housing 76*g* of the drill bit assembly 70*g*. However, the location of the cutters has been shifted to obtain the advantage of certain features of the present invention as described previously herein.

In the embodiment of FIGS. 22 and 23, there are provided four units 72*g* of two cutters each, each comprising a leading or primary cutter 82*g* and a secondary cutter 83*g* located on the same circumferential axis as its related primary cutter 82*g*. There is also provided a single primary cutter 82*g* at a more central location. Instead of having a total of nine circumferential axes, as in FIG. 6, there are only five circumferential axes, numbered one through five in FIG. 23. In this embodiment all of the primary cutters 82*g* lie in the same reference plane 121*g* so that all are at the same axial reference depth and all of the secondary cutters 83*g* lie in the same reference plane 123*g*. Thus, each unit 72*g* of cutters are positioned to function in the manner illustrated in embodiment of FIGS. 20 and 21, where the cutters 82*e* and 83*e* of that unit are at different axial depth locations, but are grouped circumferentially with respect to one another so as to be at the same operating depth locations.

It is believed that the mode of operation of this sixth embodiment of FIGS. 22 and 23 is evident from the prior description relative to the fifth embodiment of FIGS. 20 and 21. Each leading cutter 82*g* is at the same operating depth as the trailing cutter 83*g*, and each trailing cutter 83*g* is circumferentially more closely adjacent to its related primary or leading cutter 82*g* (i.e. trailing by ninety degrees), hence each trailing cutter 83*g* is "protected". Thus, in the event that it's related leading cutter 82*g* becomes damaged, the trailing cutter 83*g* is able to follow in the same circumferential path and take over the major "cutting chores" and thus effectively prolong the operating life of the drill bit assembly 70*g*. Further comparison of FIG. 22*a* to FIG. 7 will show that the arrangement of cutters into cutting groups 72*g* results in much wider cutting groove widths 66*g* as compared to the width of the cutter 65*g*. Typically groove width 66*g* will equal 60% to 80% of cutter width 65*g*.

e. Seventh Embodiment (FIGS. 24 through 27)

Figure 24:
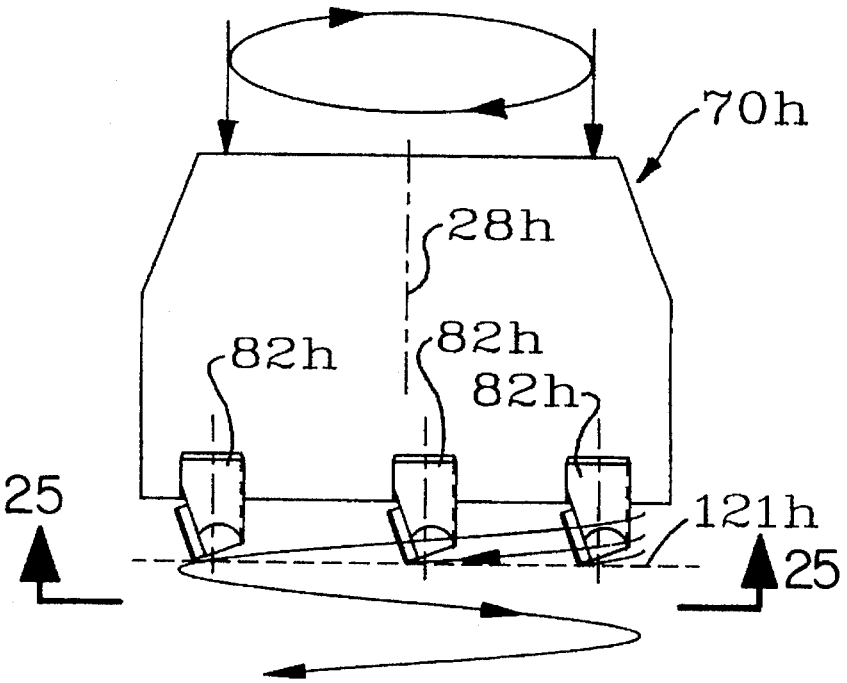
FIG. 24 PRIOR ART
FIG. 24 is a schematic drawing, similar to FIGS. 20 and 22, showing for purposes of illustration a plurality of cutters mounted in a pattern where the cutters at certain radial distances are evenly spaced and at an equal depth, this being done for purposes of explanation, and not to show an embodiment of the present invention.
Figure 25:
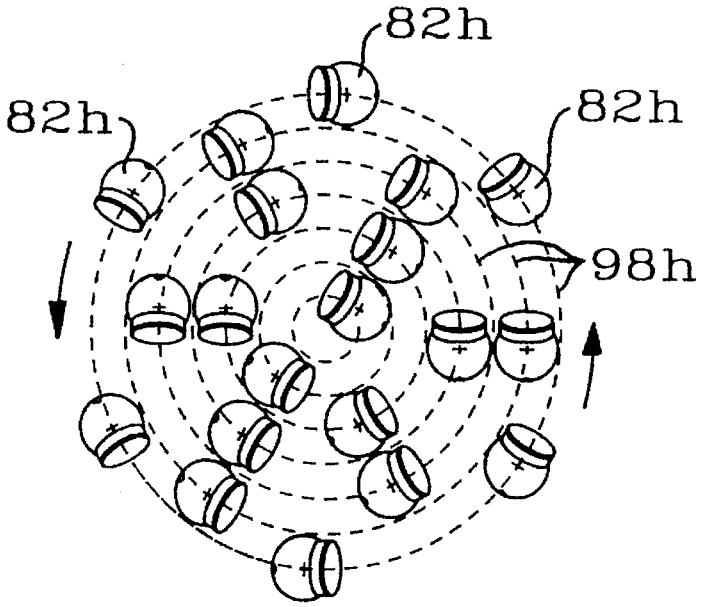
FIG. 25 PRIOR ART
FIG. 25 is an end view taken at line 25—25 of FIG. 24.
Figure 26:
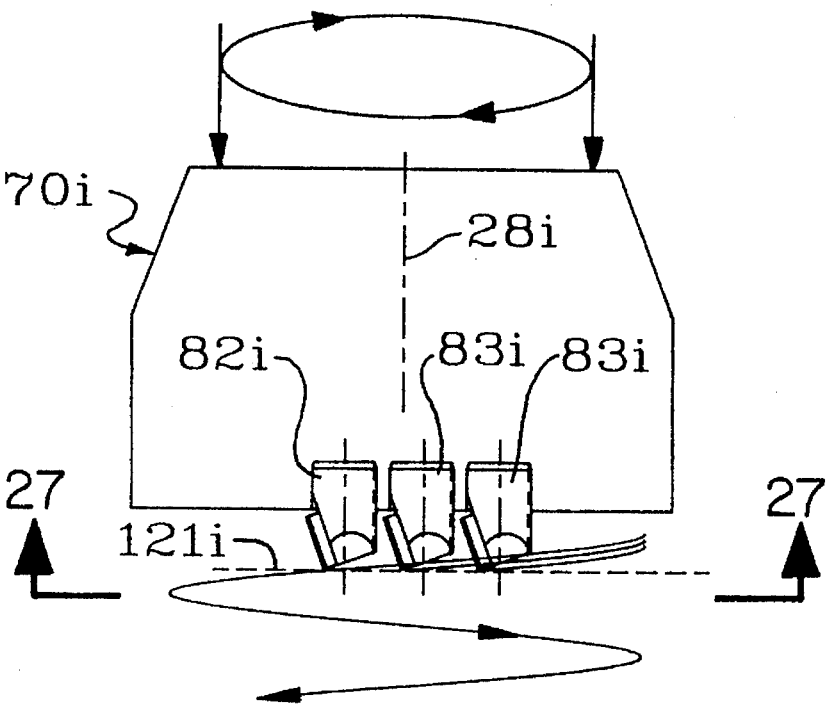
FIG. 26 is a somewhat schematic view (similar to FIG. 24), showing a seventh embodiment of the present invention, with a drill bit incorporating units of closely spaced cutters.
Figure 27:
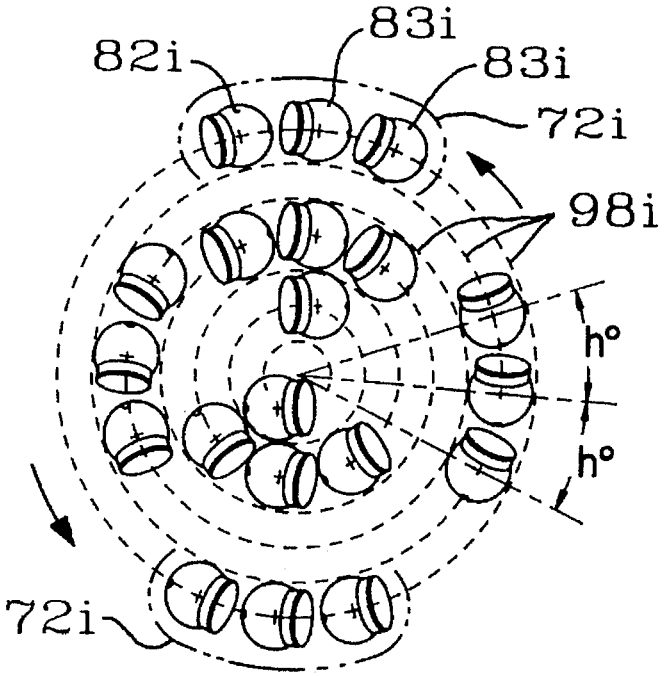
FIG. 27 is an end view taken along line 27—27 of FIG. 26.

FIGS. 24 and 25 are simply provided for purposes of illustration, and do not employ the teachings of the present invention, while FIGS. 26 and 27 illustrate the seventh embodiment of the present invention. In FIGS. 26 and 27, the same cutters illustrated in FIGS. 24 and 25 are rearranged in a manner to incorporate teachings of the present invention and thus constitute a seventh embodiment of the present invention. In discussing FIGS. 24 and 25, components which are similar to components described previously in this text will be given like numerical designations with an "h" suffix distinguishing those of FIGS. 24 and 25.

It can be seen in examining FIG. 25 that there is a plurality of cutters 82*h* arranged in seven concentric axes 98*h*. The outermost axis has six cutters 82*h* positioned symmetrically about the center longitudinal axis 28*h* and spaced equally at 60° apart. The next four circumferential axes proceeding in an inward direction, each have three cutters 82*h*, with each circumferential set being symmetrically spaced 120° apart. The two innermost circumferential axes have one cutter 82*h* apiece. All of these cutters are positioned at the same axial depth location on reference plane 121*h*. Thus, in accordance with the explanations provided earlier herein, none of these cutters 82*h* can be identified as primary or secondary cutters or "leading" or "trailing" cutters, and are, in general, subject to equal wear, it being understood that the outermost cutters as a group may tend to wear faster than cutters closer to the longitudinal center axis 28*h*.

Reference is now made to FIGS. 26 and 27 which illustrate the seventh embodiment of the present invention. Components of the seventh embodiment which are similar to components described previously herein will be given like numerical designations with an "i" suffix distinguishing those of this seventh embodiment.

It can be seen from examining FIG. 27, that the total number of cutters, and the number of cutters on each circumferential axis 98*i* is the same as in FIG. 25. However, the positions of the cutters have been grouped circumferentially in accordance with the teachings of the present invention.

Thus, it can be seen in FIG. 27 that the six outermost cutters have been grouped so as to be in two diametrically opposed units 72*i* of cutters (with three cutters in each unit). There is thus a primary cutter 82*i*, and two secondary cutters 83*i* closely following, in each of the outermost cutter units 72*i*. Also, it should be noted that the second cutter 83*i* in line would function (in the event of the primary cutter 82*i* being disabled) as the primary cutter relative to the third cutter 83*i* in line.

It will be noted that for the third through the sixth circumferential axes, there is for each circumferential axis a group of three cutters closely adjacent to one another, so that in each unit 72*i* of three cutters, there is the primary cutter 82*i* and two secondary cutters 83*i*. These units 72*i* are also circumferentially positioned in a pattern to substantially balance the axial forces exerted on the cutters 82*i* and 83*i* and transmitted into the drill bit housing.

As can be seen in FIG. 26, which shows only one unit of three cutters 82*i*–83*i*, the cutters 82*i*–83*i* are arranged at the same axial depth location. However, the separation angles, indicated as "h" in FIG. 27 are quite small ranging from less than 20° for the outer cutter groups 72*i* to no more than 45° for the innermost cutter groups 72*i*. Thus, the cutting depth for the trailing cutters 83*i* will initially be small, expressed as the ratio of h°/360° to the cut depth of the primary leading cutters 82*i*, as previously described for FIGS. 18 and 19. However, it is to be understood that the axial relative depth locations could be modified, as shown in the eighth embodiment of FIGS. 28, 28*a* and 29, and in the fifth embodiment of FIGS. 20 and 21.

It is believed that the mode of operation of this seventh embodiment of FIGS. 26 and 27 is readily apparent from the explanations given previously in this text, so this will not be repeated at this time. Briefly each lead cutter 82*i* cuts to a greater axial depth, thus "protecting" the trailing cutters 83*i* which will wear at a slower rate and carry more of the cutting load upon damage or excessive wear of the lead cutter 82*i*.

f. Eighth Embodiment (FIGS. 28, 28A and 29)

Components of this eighth embodiment which are similar to components of earlier embodiments will be given like numerical designations with a "j" suffix distinguishing those of this eighth embodiment.

This eighth embodiment combines the teachings of the second embodiment (FIGS. 10 and 11) with the teachings of the fourth embodiment (FIGS. 18 and 19), and also with the teachings of the seventh embodiment (FIGS. 26 and 27), relative to the use of multiple secondary cutters in a single cutter unit. FIG. 28A shows a modification of FIG. 28 and incorporates the teachings of the fifth embodiment of FIGS. 20 and 21, but employing two secondary cutters in each cutter unit.

Figure 28:
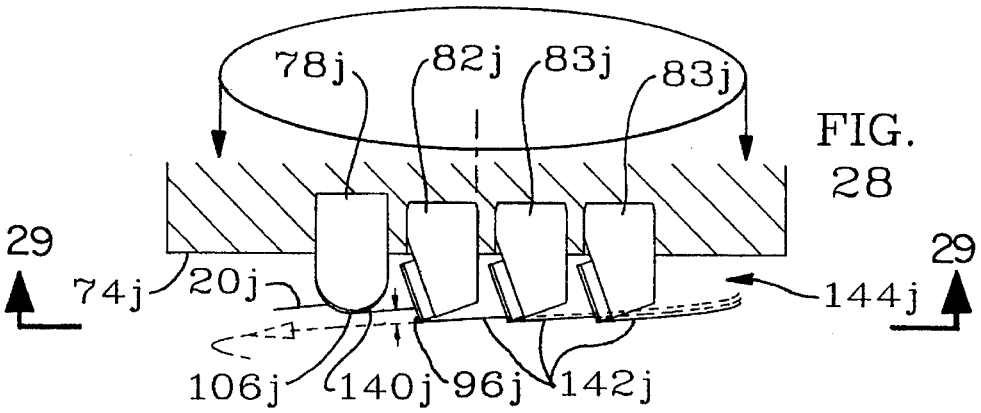
FIG. 28 is a somewhat schematic drawing (similar to FIG. 26) showing yet an eighth embodiment of the present invention where the teachings of the embodiment shown in FIGS. 10 through 13 are combined with the teachings of the embodiment of FIGS. 20 and 21 in a drill bit.
Figure 28A:
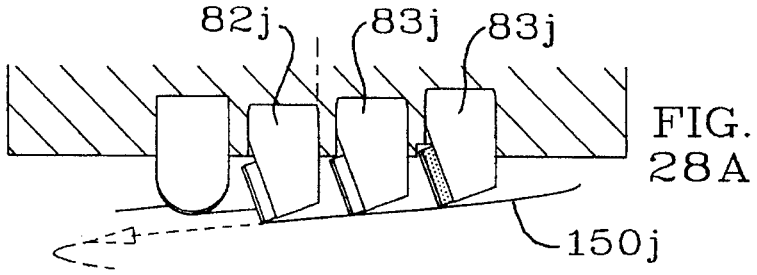
FIG. 28A is a view similar to FIG. 28 showing a variation of the embodiment of FIG. 28.
Figure 29:
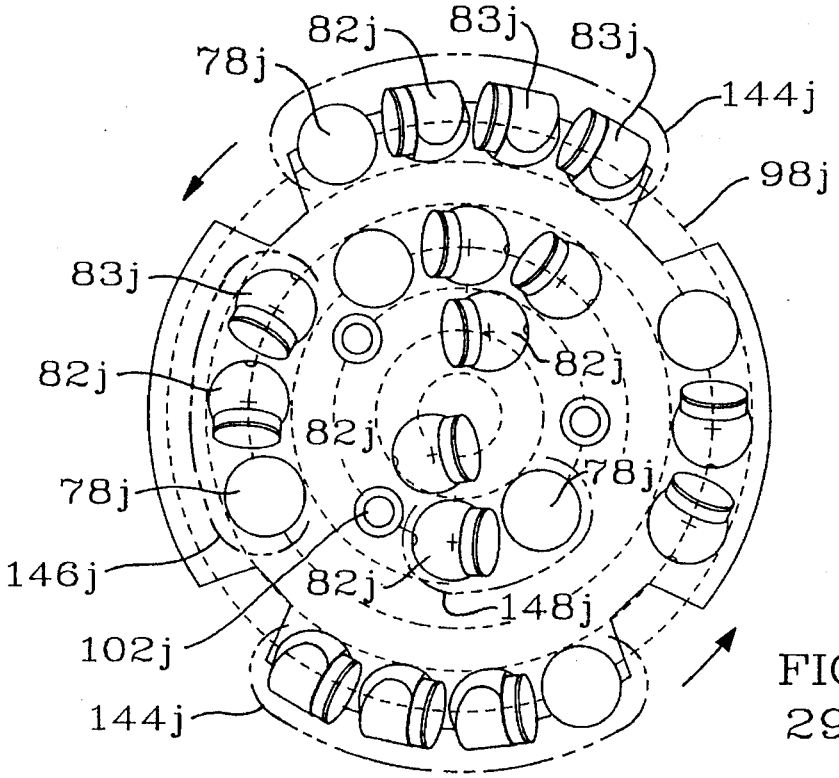
FIG. 29 is an end view taken at line 29—29 of FIG. 28.

In FIG. 28, there is shown only a single cutter unit 144*j*, where there is a forward positioning cutter 78*j*, followed immediately by a primary relatively sharp cutter 82*j*, which in turn is followed by two secondary cutters 83*j* positioned in line with one another and on the same axial depth reference plane.

In this particular arrangement, the primary cutter 82*j* has its lowermost part of its cutting edge 96*j* positioned at distance "s" lower than the lowermost contact portion 106*j* of the positioning cutter 78*j*, as shown previously in FIG. 10, the second embodiment. In FIG. 28 there is shown somewhat schematically a line representing the rock surface 20*j*, the cutting or engagement path 140*j* of the positioning cutter 78*j*, and at 142*j* the projected helical paths of travel of the three cutters 82*j* and 83*j*. It can be seen that with the cutters 82*j* and 83*j* being at the same axial depth, and closely adjacent along the circular cutting paths 98*j*, the three helical cutting paths 142*j* are spaced from one another a rather short vertical distance.

With reference to FIG. 29, it can be seen that the two outermost cutter units (indicated at 144*j*) have the four cutters 78*j*–82*j*–83*j*, with the last two cutters 83*j* being secondary cutters, as shown in FIG. 28. The next three radially inward cutter units 146*j* comprise simply the positioning cutter 78*j*, one primary cutter 82*j*, and one secondary cutter 83*j*. The next inward cutting unit 148*j* has only a single positioning cutter 78*j* and a single primary cutter 82*j* and is thus the same as the cutter combination 78*b* and 82*b* illustrated in FIGS. 10 and 11. The two innermost cutters 82*j* are simply primary cutters.

In this arrangement, the outermost cutting units 144*j* which are more susceptible to wear and damage have the greatest degree of "backup" with the two backup cutters 83*j*, and both are on the same circumferential outermost axis 98*j*. The next three set of cutter units 146*j* only have the single backup cutter 83*j*. Also, it will be noted that flush liquid discharge openings 102*j* provide flushing liquid going into the operating area adjacent to the drill housing surface 74*j*.

It is believed that the operation of this seventh embodiment of FIGS. 28 and 29 is evident from the explanations given previously in this text.

It can be seen in FIG. 28 that the primary cutter 82*j* is so positioned relative to the positioning cutter 78*j* that the depth of cut "s" (measured from the path 140*j* of the lowermost contact point 106*j* of the positioning cutter 78*j* to the path 142*j* of the lowermost cutting edge 96*j* of the primary cutter 82*j* is controlled by the positioning cutter 78*j* and is substantially greater than the cut depths along the three paths 142*j* of the cutters 83*j*. Thus, it can be appreciated that the primary cutter 82*j* is carrying the major "cutting chores", while the following cutters 83*j* each have a very shallow cut at most. Thus, as shown in FIG. 28, the cutters 82*j*–83*j* are operating in rather the same manner as the cutters 82*i*–83*i* shown in FIGS. 26 and 27.

FIG. 28A shows a modified axial depth positioning of the cutters 83*j* relative to the cutter 82*j*, so that these are positioned all at the same axial reference path along helical path 150*j*. Thus, it is apparent that the two trailing cutters 83*j* of FIG. 28A are positioned axially at a lesser depth relative to the leading cutter 82*j* in FIG. 28A. Thus, the trailing cutters 83*j* in FIG. 28A are operating in the manner of the trailing cutter 83*f* as shown in FIGS. 20 and 21.

In both of the arrangements of FIG. 28 and FIG. 28A, each of the forward primary cutter 82*j* is carrying the brunt of the cutting load but somewhat protected by positioning cutter 78*j* which is controlling the maximum cut depth "s". In the event of excessive wear or fracture of the primary cutter 82*j*, the trailing cutters 83*j* begin to take over more of the cutting burden.

E. Further Embodiments Applying Ultra High Pressure Liquid Jet Cutting a. The Ultra-high Power Jet Cutter (A Ninth Embodiment Shown in FIGS. 30 and 31)

In describing this ninth embodiment, there will be "k" suffices added to the numerical designations, and components of this ninth embodiment which are similar to components previously described will be given like numerical designations, with the "k" suffix distinguishing those of this embodiment.

Figure 30:
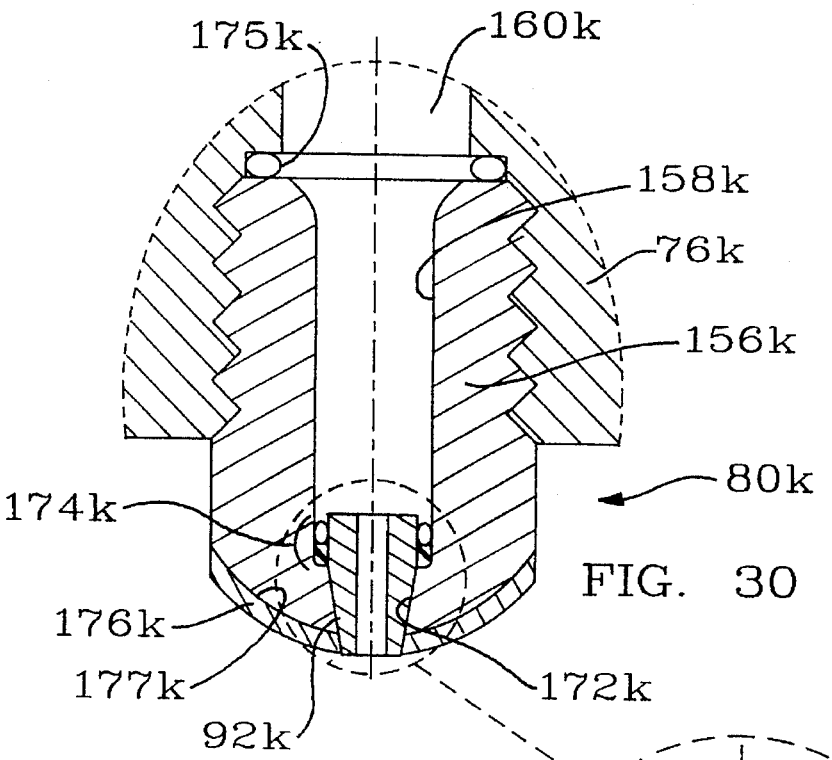
FIG. 30 is a sectional view taken along a longitudinal axis of an ultra high pressure liquid jet unit, this being a ninth embodiment of the present invention, adapted for use in the drill bit assembly of the present invention.
Figure 31:
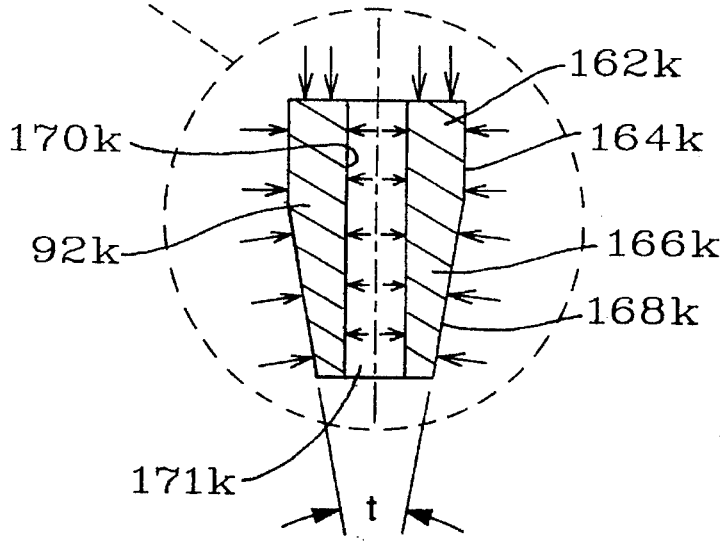
FIG. 31 is a longitudinal sectional view of only the nozzle element shown in FIG. 30 and circled, as indicated at 31 in FIG. 30.

In FIG. 30, there is shown the ultra high pressure liquid jet cutter 80*k* that was described briefly as it is incorporated in the first embodiment of FIGS. 8 and 9. FIG. 31 shows the liquid jet cutter nozzle element 92*k* to an enlarged scale. It can be seen that the nozzle element 92*k* is positioned in a cylindrical housing 156*k* threadedly mounted into the drill bit housing 76*k*. The housing 156*k* has a vertical through passageway 158*k* to receive ultra high pressure liquid (usually water or water with abrasive particles entrained therein) from a passage 160*k* formed in the housing 76*k*.

The nozzle 92*k* has an upper cylindrical portion 162*k* (see FIG. 31) having an outer cylindrical surface 164*k* and a lower downwardly and inwardly tapering portion 166*k* having a frusto conical outer surface 168*k*. The nozzle 92*k* defines an interior through passage 171*k* having a cylindrical or conical wall 170*k*. The nozzle element 92*k* is positioned in the housing 156*k* so that the frusto conical surface 168*k* fits snugly within a closely matching frusto conical recess 172*k* formed in the lower end of the jet cutter housing 156*k*. There is an ultra high pressure seal assembly 174*k* positioned around the upper cylindrical surface 164*k* of the nozzle element 92*k* and a second ultra high pressure seal 175*k* between the nozzle housing 156*k* and drill bit housing 76*k*.

It can be seen that the liquid pressure exerted by the fluid against the interior passageway surface 170*k* of the nozzle element 92*k* can be reacted into the adjacent walls of the jet cutter housing 156*k*. Particularly, with the liquid force in the passageway 158*k* pressing against the upper end of the nozzle element 92*k*, the slanted housing surface around the lower frusto conical nozzle element surface 168*k* exerts radially inward loads on the nozzle element 92*k*. This can offset the tensile force as generated from the fluid pressure within the nozzle element 92*k*, thus enabling hard brittle materials like diamond, PDC and TSD that are weak in tension to be used in the ultra high pressure nozzle element 92*k* without cracking from internal pressure. The angle (indicated at "t") for the frusto conical surface 168*k* can be varied for different orifice materials and orifice diameters to achieve proper force balance. Normally, it would be expected that this angle "t" would be between about 6° to 30°.

The lower surface 177*k* of the jet cutter housing 156*k* is covered with a durable wear coating layer 176*k*, such as Conforma Clad tungsten carbide matrix in order to survive the severe erosion caused by abrasive particles driven by the rebounding ultra high power jet that impinges on the rock surface. It will be noted that this surface 177*k* and the protective layer 176*k* have an upward and outward taper to deflect any rebounding liquid and particles radially outwardly from the opening of the nozzle element 92*k* itself.

b. The Ultra High Power Jet Cutter Incorporated In a Single Cutting Unit (Tenth Embodiment—FIGS. 32–35)

Figure 32:
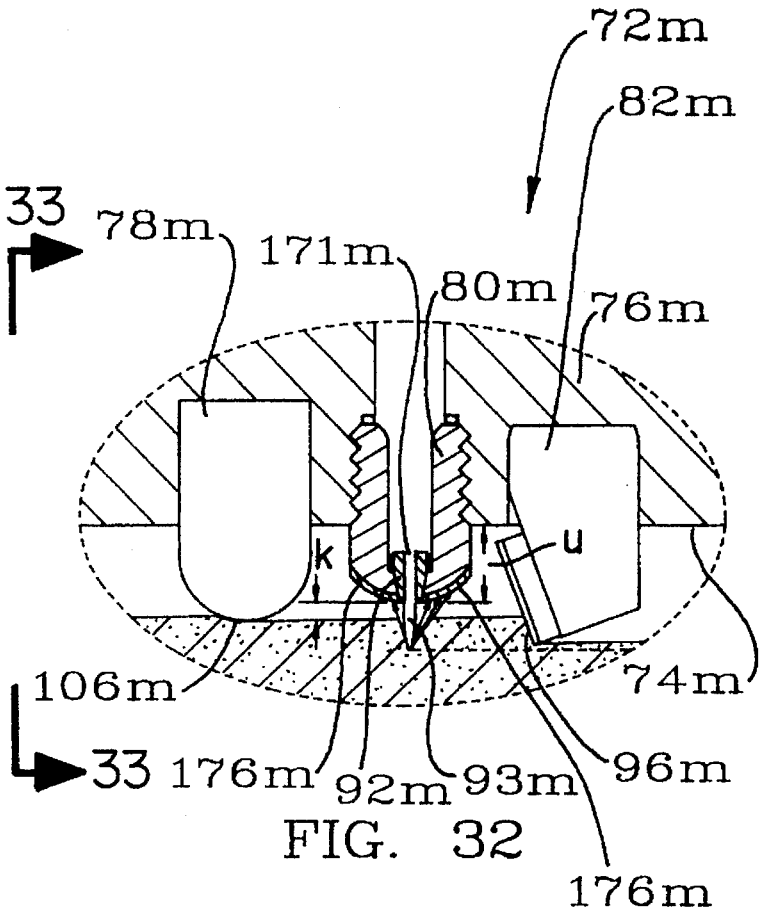
FIG. 32 is a sectional view similar to FIG. 10 showing the cutter unit of a ninth embodiment of the present invention, incorporating the eighth embodiment of FIGS. 30 and 31.
Figure 33:
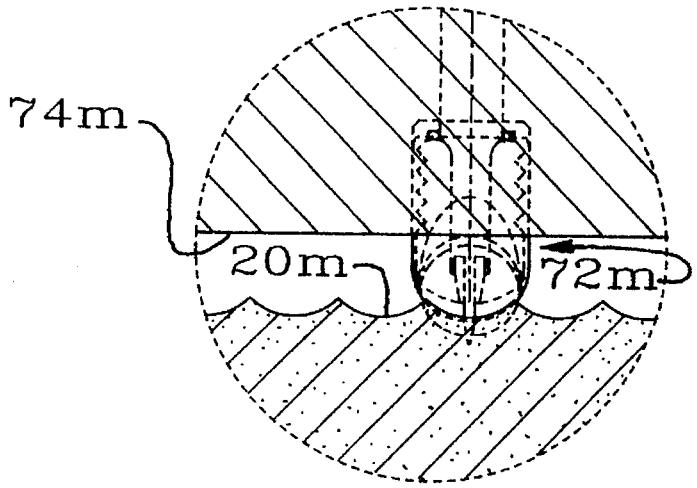
FIG. 33 is a sectional view taken along line 33—33 of FIG. 32.

FIG. 32 shows the liquid jet cutter unit 80 of FIG. 30 incorporated in a cutter unit which constitutes the tenth embodiment of the present invention. Components of this tenth embodiment which are similar to components described earlier herein will be given like numerical designations, with an "m" suffix distinguishing those of this tenth embodiment.

Thus, the cutter unit 72*m* comprises a forward positioning cutter 78*m*, followed by the liquid jet cutter 80*m*, which is in turn followed by a primary, relatively sharp cutter 82*m*. The positioning cutter 78*m* functions in substantially the same manner as described previously herein, relative to the relatively sharp primary cutter 82*m*. Thus, (as described earlier herein), the lower cutting edge 96*m* of the cutter 82*m* is positioned at a slightly greater depth (e.g. 0.05 to 0.15 inches generally) than the lowermost contact point 106*m* of the positioning cutter 78*m*. On the other hand, the lowermost surface portion of the protective layer 176*m* and the lowermost end of the nozzle element 92*m* are positioned a short distance above the depth position of the lowermost contact point 106*m* of the positioning cutter 78*m*. (This spacing distance being indicated at "k" in FIG. 32). This spacing distance "k" should be no greater than about seven times the diameter of the smallest portion of the nozzle element passageway 171*m*. Normally, the diameter of the smallest portion of the nozzle passageway 171*m* would be between about 0.020 to 0.050 inch, and the spacing distance "k" would normally be between about 0.050 to 0.250 inch.

Figure 34:
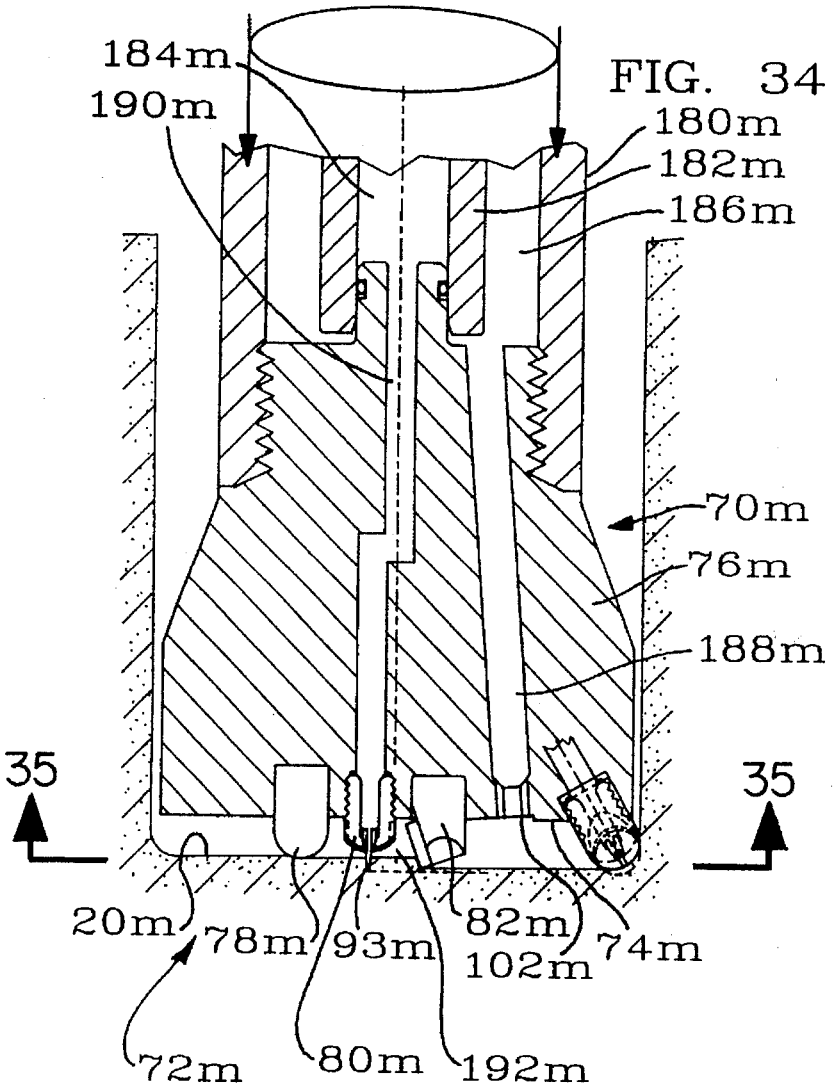
FIG. 34 is a view illustrating the cutter unit illustrated in FIGS. 32 and 33 as the ninth embodiment, incorporated in a drill bit assembly, and also showing the lower part of a drill stem to which the assembly is mounted.

FIG. 34 shows the cutter unit 72*m* incorporated in a drill bit assembly 70*m*. There is a drill stem or string 180*m* to which the drill bit assembly 70*m* is removably attached. The drill string 180*m* has positioned concentrically therein an inner tubular member 182*m* defining an inner passage 184*m* to carry the ultra high pressure cutting liquid. This tubular member 182*m* also defines with the drill stem 180*m* an annular passageway 186*m* that carries the flushing liquid.

The drill bit housing 76*m* has a plurality of passageways 188*m* to carry the flushing liquid to the operating surface 74*m* of the housing 76*m* to be discharged through a plurality of flush liquid outlet openings 102*m*. The drill bit assembly 70*m* also has a plurality of ultra high pressure liquid passageways 190*m* that carry the ultra high pressure liquid to the plurality of liquid jet cutters 80*m*. For ease of illustration, only one flushing liquid passageway 188*m* and one ultra high pressure liquid passageway 190*m* are shown herein. It is to be understood, however, that a plurality of such passageways would be provided, or if a single such passageway is provided, there would be a manifold arrangement where a flushing liquid and also the ultra high pressure liquid would be appropriately distributed to respective exit openings 102*m* or liquid jet cutters 80*m*.

Figure 35:
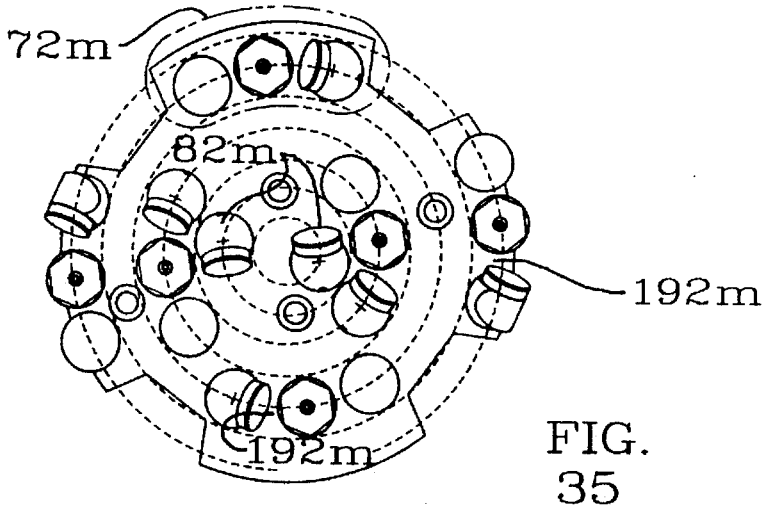
FIG. 35 is an end view taken at the location of line 35—35 of FIG. 34.

FIG. 35 is an end view of the drill bit housing showing a plurality of cutter units 72*m* incorporating the liquid jet cutter. It can readily be seen by comparing FIG. 35 with FIG. 9 that the arrangement of the cutter units 72*m* is substantially the same as that shown in FIGS. 8 and 9 (which describe the first combined embodiment of the present invention), except that the trailing cutters 83 of the embodiment of FIGS. 8 and 9 are not provided.

Another important feature of the present invention will now be described with reference to FIGS. 34 and 35. It can be seen in FIG. 34 that the cutter units 78*m*, 80*m* and 82*m* extend below the operating surface 74*m* of the drill bit housing 76*m*. Thus, there is around and between each and every cutter 78*m*, 80*m* and 82*m* fluid flow paths between the drill bit surface 74*m* and the end surface 20*m* of the rock formation. This is significant with respect to the liquid jet cutters 80*m* in substantially diminishing the effect of splash back of the ultra high pressure liquid. As the high pressure jet 93*m* penetrates into the rock formation to make a rather narrow kerf, it will create small rock fragments that will be carried by the liquid at very high velocity. As these strike against the slanted surface provided by the wear resistant cover, these will be deflected laterally outwardly to flow in the liquid passageways, some of which are indicated at 192*m*.

It has been found that if the lower end surface of the wear resistant cover 176*m* is between about 0.3 to 0.7 inch below the operating surface 74*m* of the housing 76*m*, there is adequate space for the liquid flow. This is indicated as distance "u" in FIG. 32. To describe the overall operation, the drill stem 180*m* is rotated and forced downwardly into the rock formation as described previously, and the flushing liquid is discharged through the outlet openings 102*m* to remove the rock fragments where they are being cut and carry these upwardly around the drill bit housing 76*m* and upwardly around the drill stem 180*m*.

The operation and functions for the positioning cutters 78*m* and the stationary sharp cutters 82*m* is generally the same as described above. It has been found that the addition of the liquid jet cutter 80*m* between the positioning cutter 78*m* and the sharp cutter 82*m* of each cutter unit 72*m* provides significant benefits. The high velocity liquid jet (indicated at 93*m*) impinges upon the rock surface 20*m* to cut a narrow kerf at a central location along the circumferential path of its related cutter unit 72*m*. This weakens the rock formation along that circumferential path and enables the cutter 82*m* immediately behind to more easily cut into the rock formation, thus reducing the forces that wear or fracture cutter 82*m*.

Figure 36:
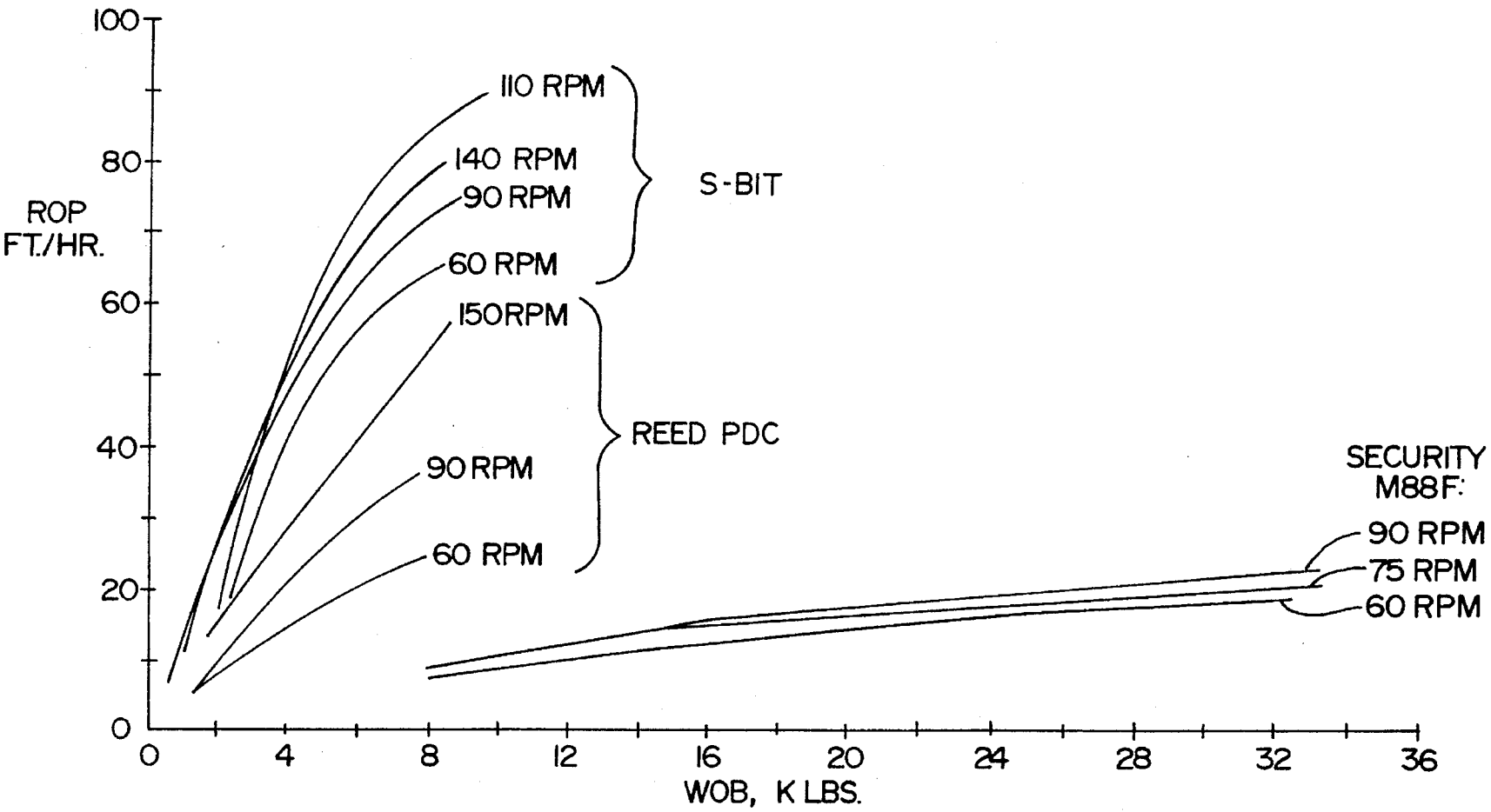
FIG. 36 is a graph illustrating the operating results utilizing the present invention incorporating liquid jet cutting relative to standard drill bit assemblies.

At the same time, the presence of the positioning cutter 78*m* protects the liquid jet cutter 80*m* from coming into contact with the rock formation and thus being damaged. As described previously herein, with the liquid jet cutter 80*m* being immediately behind its related position cutter 78*m*, when a hard rock formation or obstacle is encountered by the positioning cutter 78*m*, this cutter 78*m* rides upwardly over the hard rock formation, thus lifting the liquid jet cutter 80*m* and the cutter 82*m* upwardly. This maintains the liquid jet cutter 80*m* a spaced distance above the rock formation, while (as described previously) it limits the depth of cut of the sharp cutter 82*m* as it arrives at the hard rock section in the formation.

c. Improved Results Obtained By Utilizing The Liquid Jet Cutter In Conjunction With the Positioning Cutter and the Relatively Sharp Stationary Cutter To demonstrate the results achieved by this tenth embodiment shown in FIGS. 32 through 35, tests were conducted as follows, with the results being shown as graphs in FIG. 36.

First, as a reference, a standard PDC fixed cutter drill bit manufactured by Reed Tool Co. was provided. This drill bit had a drill housing with a diameter of 4.75 inch, and there were provided 3 flush liquid passageway openings extending through the lower operating face of the drill bit. There was a plurality of 16 relatively sharp cutters, such as shown and described at 82 in this application. These were spaced circumferentially around the surface of the cutter, and each of these was positioned in a respective circumferential axis, there being 10 circumferential axes in all.

Then there was provided a drill bit assembly 70*m* such as indicated and described at 70*m* with reference to FIGS. 32 through 35. This drill bit assembly had a plurality of cutter units 72*m*, each of which comprised a positioning cutter, a liquid jet cutter and a trailing relatively sharp stationary cutter (as described at 78*m*, 80*m* and 82*m*). The drill bit housing was 4.75 inch across, and 4 cutter units (each comprising the positioning cutter, the liquid jet cutter, and the stationary cutter) were provided. Two cutters 82*m* were provided near the longitudinal center axis along with three flush liquid passageway openings 102*m*. The cutter units 72*m* and cutters 82*m* comprised a total of six circumferential axes. Ultra high pressure water was directed through each of the liquid jet cutters at a pressure of 30,000 PSI. The lowermost surface portion of each Liquid jet cutter was positioned above the lowermost edge portion of its related positioning cutter by a distance of about 0.05 inch. The lowermost cutting edge of each stationary cutter was positioned about 0.12 inch below the lowermost surface point of the positioning cutter.

The experiment was conducted by utilizing the standard drill bit to drill through Carthage marble (Burlington limestone) sitting inside a pressure vessel and surrounded by ambient fluid pressure of 1,500 PSI. Drilling rates (ROP) at various rotary speeds (rpm) and WOB (weight on bit, i.e. axial thrust) were recorded.

Then the drill bit assembly of the present invention, as described immediately above in this section, was also utilized in the same rock sample in a similar fashion.

The results of these tests were that, for a similar rpm and wob, the drill bit assembly of the present invention drilled over two times faster than the conventional PDC drill bit.

For further comparison, standard tri-cone drill bits were utilized. These were tri-cone bits that are commercially available, including one manufactured by the Reed Tool Co., Model Q5 and one manufactured by the Security Drill Bit Co., Model M88F.

These comprise three conical elements mounted for rotation about radially extending axes, and based circumferentially around the operating face of the drill bit assembly. As illustrated in the graph, the tri-cone bits drilled only about ¼ as fast as the bit assembly of the present invention.

d. The Ultra High Power Jet Cutter Incorporated in a Single Cutting Unit With Sharp Cutters (Eleventh Embodiment FIGS. 37, 37*a* and 38)

This eleventh embodiment combines the teachings of the embodiment shown in FIGS. 18 and 19, the embodiments shown in FIGS. 20 and 21, and also the embodiments shown in FIGS. 26 and 27, with the ultra high power jet cutter disclosed in FIGS. 30 and 31. Components of this eleventh embodiment which are similar to components previously disclosed herein will be given like numerical designations, with an "n" suffix distinguishing those of the eleventh embodiment.

Figure 37:
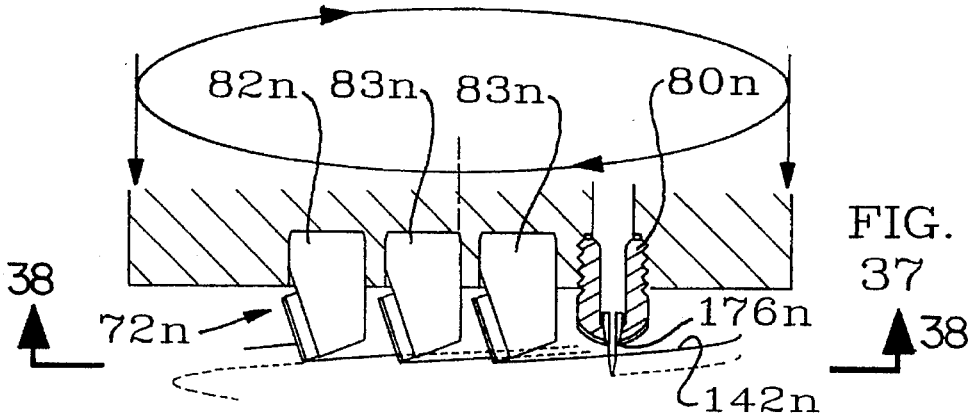
FIG. 37 is a view similar to FIG. 28, but showing a tenth embodiment of the present invention.

In FIG. 37, there is shown a single cutter unit 72*n* comprising a sharp leading or primary cutter 82*n*, and two trailing or secondary cutters 83*n* and liquid jet cutter 80*n*. These cutters 82*n* and 83*n* have their lower edge all at the same axial location, and thereby function in somewhat the same manner as the cutters shown in the embodiments of FIGS. 18 and 19. Also, this arrangement of the cutters is similar to that shown in FIG. 28, where three sharp cutters 82*j* and 83*j* are shown in that same arrangement. As pointed out in the description of the cutter arrangement in FIG. 28, the second cutter 83*j* which is a secondary cutter relative to the leading sharp cutter 82*j* will (when the second cutter 83*j* becomes a primary cutter) act as a primary cutter relative to the third cutter 83*j* which still at that time is functioning as a secondary cutter.

The lowermost surface portion of the protective layer 176*n* of the liquid jet cutter 80*n* is positioned a moderate distance above the lowermost helical path 142*n* of the third sharp cutter 83*n*.

In the operation of the cutter unit 72*n* shown in FIG. 37, initially the lead cutter 82*n* carries the brunt of the cutting load, while the second and third trailing cutters 83*n* act as secondary cutters in the manner described previously herein. As the first primary cutter 82*n* becomes damaged or wears away, then the second cutter 83*n* becomes the primary cutter, with the third cutter 83*n* remaining as a secondary cutter. Eventually, at such time as the second cutter 83*n* is fractured or wears away, then the third cutter 83*n* becomes the sole primary cutter. At that time, the lower edge portion of the third cutter 83*n* would still be sufficiently low so as to provide protection for the liquid jet cutter 80*n* so that it would not become damaged by contact with the rock surface.

Figure 37A:
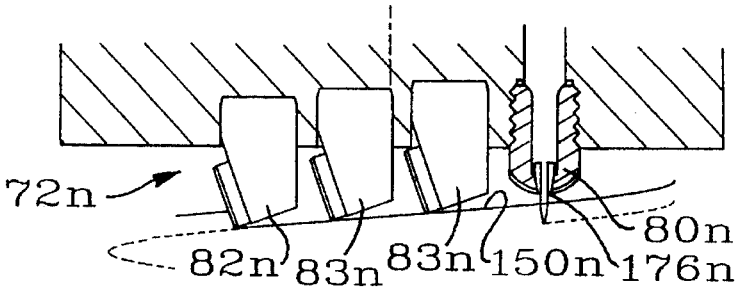
FIG. 37A is a view similar to FIG. 28A, showing a modification of the tenth embodiment illustrated in 37.

A modified arrangement is shown in FIG. 37A where the three cutters 82*n*, and 83*n* are arranged so as to be positioned in the same operating reference line 150*n*. It will be noted that the lowermost surface portion 176*n* of the liquid jet cutter 80*n* in FIG. 37A is above this operating line 150*n*. The cutter unit 72*n* shown in FIG. 37A works in substantially the same manner as that shown in FIG. 37, except that the cutters are positioned on the operating reference line 150*n*, instead of all being at the same axial cutter depth.

Figure 38:
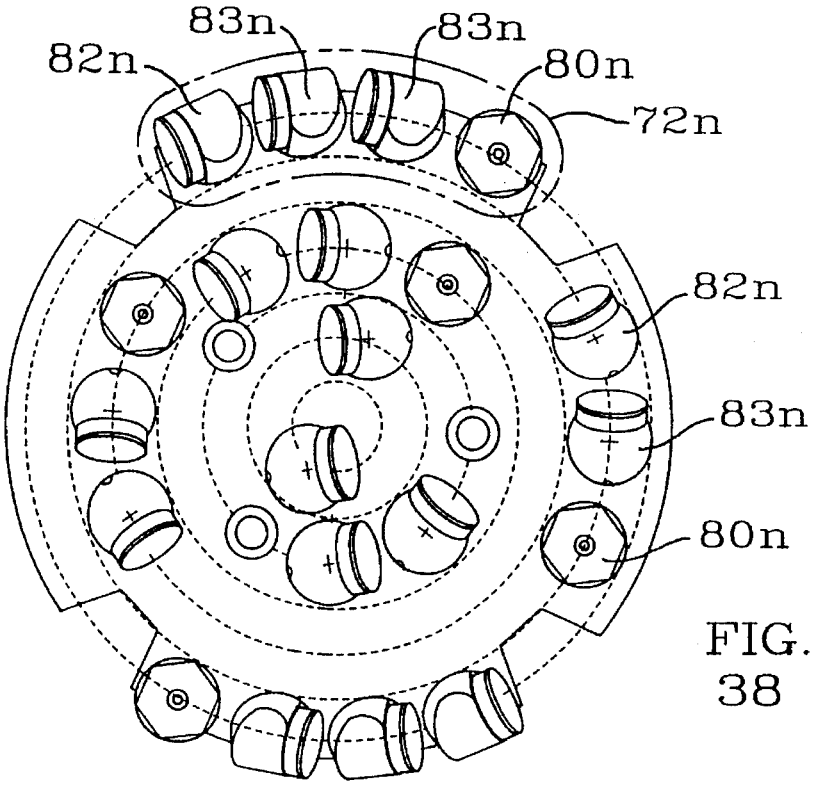
FIG. 38 is an end view of the tenth embodiment shown in FIG. 37, taken at line 38—38 of FIG. 37.

FIG. 38 illustrates the use of the cutter units 72*n* shown in FIGS. 37 arranged in an actual drill bit. It will be noted that there are seven circumferential axes, with two full cutter units 72*n* positioned on the outermost axis. On the fourth, fifth and sixth axis, there are only two sharp cutters 82*n* and 83*n* used in conjunction with a single ultra high pressure nozzle 80*n*.

The ultra high pressure jet cutter 80*n* is not employed in the innermost three circumferential axes.

It is believed that the mode of operation of this eleventh embodiment is readily understandable from the explanations given previously in this text. Briefly, the ultra high pressure liquid jet cutter 80*n* is positioned behind the sharp cutters so that it cuts into the groove or kerf formed immediately ahead by the cutters 82*n*/83*n*. This weakens the rock so that on the subsequent pass of the cutters 82*n* and 83*n* they are better able to cut into the rock formation. In comparing this to the embodiment of FIGS. 32 through 35, the cutters 82 and 83 are serving the function of protecting the liquid jet cutter 80*n* from damage by the rock formation, and in providing a freshly exposed rock surface 142*n* that can be more easily cut by the liquid cutting jet immediately following the scraping action of the rearmost sharp cutter 83*n*.

It is obvious that various modifications and/or arrangements can be made without departing from the basic teachings of the present invention.

What is claimed:

1. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis; said cutter unit comprising:

i. a forwardly located lead positioning cutter having at a lower end thereof a lower relatively hard positioning portion having a downwardly facing relatively blunt contact surface, which contact surface is located axially at a lower positioning location at the lower end of said positioning cutter to engage material at the drill hole end wall at said circumferential path said positioning cutter has a relatively hard material removal surface portion of said contact surface extending forwardly and upwardly from a lowermost positioning surface portion of said contact surface in a manner to be able to engage and remove at least some material from said drill hole end wall;

ii. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole, whereby, in operation, said lead positioning cutter engages the drill hole end wall to locate the drill bit assembly axially relative to the end wall of the drill hole, and thus locate the cutting depth of the trailing cutter axially relative to the circumferential path.

2. The assembly as recited in claim 1, wherein said contact surface of the positioning cutter has side surface portions extending upwardly and laterally from said lower positioning surface portion, relative to said circumferential cutting axis.

3. The assembly as recited in claim 2, wherein said positioning surface portion, said forwardly and upwardly slanting surface portion, and said side surface portions collectively form a downwardly facing generally convexly curved contact surface.

4. The assembly as recited in claim 3, wherein said convexly curved surface has a material engaging surface portion between about 40 to 180 degrees of curvature, and has a radius of curvature between about ⅕ to ½ inch.

5. The assembly as recited in claim 4, wherein said degree of curvature is between about 80 to 140 degrees, and said radius of curvature is between about ¼ to ⅓ inch.

6. The assembly as recited in claim 4, wherein said cutting assembly comprises a plurality of said cutter units, each of which is positioned at a respective circumferential cutting path with the cutting paths each having a respective radial distance from said longitudinal axis, adjacent cutting paths of radially spaced cutting units being spaced radially from one another by a spacing distance no greater than a radially aligned width dimension of said convexly cupped contact surface of said positioning cutter.

7. The assembly as recited in claim 2, said cutting assembly comprises a plurality of said cutter units, each of which is positioned at a respective circumferential cutting path with the cutting paths each having a respective radial distance from said longitudinal axis, adjacent cutting paths of radially spaced cutting units being spaced radially from one another by a spacing distance no greater than a radially aligned width dimension of said contact surface of said positioning cutter.

8. The assembly as recited in claim 9, wherein the radially aligned width dimension of said contact surface is between about 60 to 100 percent of the spacing distance of the cutting paths of the radially adjacent cutting units.

9. The assembly as recited in claim 8, wherein the radially aligned width dimension of said contact surface is between 80 to 100 percent of the spacing distance of the cutting paths of the radially adjacent cutting units.

10. The assembly as recited in claim 2, wherein:

a. said positioning surface portion and said side surface portions of said contact surface comprise a contact surface area having a contact width dimension measured radially from outside edges of the side surface portions of the contact surface;

b. said trailing cutter being a fixed cutter having a forwardly facing fixed relatively sharp cutting edge portion having a lower middle cutting edge portion and side cutting edge portions, said cutting edge having a cutting width dimension;

c. said contact width dimension being greater than said cutting width dimension in a manner that said side surface portions of contact surface extend laterally beyond a kerf cut by the cutting edge of said trailing cutter.

11. The assembly as recited in claim 10, wherein said contact width dimension is at least one tenth greater than said cutting width dimension.

12. The assembly as recited in claim 11, wherein said contact width dimension is between about 1/10 to ¼ times greater than said cutting width dimension.

13. The assembly as recited in claim 10, wherein said contact width dimension is no greater than about one quarter times greater than said cutting width dimension.

14. The assembly as recited in claim 1, wherein there is a plurality of said cutter units positioned at said operating surface at different circumferential axes.

15. The assembly as recited in claim 1, wherein there is a plurality of said cutter units positioned at said operating surface at different circumferential axes.

16. The assembly as recited in claim 1, wherein:

a. said cutter unit travels axially in a generally helical path having a helical axis, as the drill bit assembly, in operation, rotates and travels downwardly as said drill bit assembly removes material from the end wall of the drill hole;

b. said assembly having an operational depth dimension reference line, measured at angularly spaced locations around a circumferential axis of said helical path relative to axial distance from said helical path;

c. said assembly having an axial depth dimension reference line measured relative to locations on the drill bit assembly along a plane that is fixedly located at an axial location on the drill bit assembly perpendicular to the longitudinal axis;

d. said trailing cutter having a lowermost cutting edge portion which is lower, relative to the operational depth dimension line, than a lowermost portion of the contact surface of the positioning cutter.

17. The assembly as recited in claim 16, wherein said lowermost cutting edge portion has an axial location at least as low as the lowermost portion of the contact surface of the positioning cutter, relative to the axial depth dimension reference line.

18. The assembly as recited in claim 17, wherein said lowermost cutting edge portion has an axial location lower than the lowermost portion of the contact surface of the positioning cutter, relative to the axial depth dimension reference line.

19. The assembly as recited in claim 17, wherein said lowermost cutting edge portion is at least about one twentieth of an inch below said lowermost portion of the contact surface, relative to the axial depth dimension reference line.

20. The assembly as recited in claim 19, wherein said lowermost cutting edge portion is no more than about one and one half tenths of an inch below said lowermost portion of the contact surface, relative to the axial depth dimension reference line.

21. The assembly as recited in claim 18, wherein said lowermost cutting edge portion is no more than about one and one half tenths of an inch below said lowermost portion of the contact surface, relative to the axial depth dimension reference line.

22. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. a plurality of cutter units, mounted at said operating surface at different circumferential axes along a circumferential cutting path having a circumferential axes at a pre-determined radial distances from the longitudinal axis, in a manner that as said drill bit assembly rotates about said longitudinal axis, said cutter units travel along said circumferential cutting path in a forward direction around said longitudinal axis; each cutter unit comprising:

i. a forwardly located lead positioning cutter having a lower relatively hard positioning portion having at a lower end thereof a downwardly facing relatively blunt contact surface, which contact surface is located axially at a lower positioning location at the lower end of said positioning cutter to engage material at the drill hole end wall at said circumferential path;

ii. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

iii. a secondary trailing cutter which has a cutting edge and is positioned on said circumferential axis rearwardly of said trailing cutter, which is a primary cutter, whereby, in operation, said lead positioning cutters engage the drill hole end wall to locate the drill bit assembly axially relative to the end wall of the drill hole, and thus locate the cutting depth of the trailing cutter axially relative to the circumferential path.

23. The assembly as recited in claim 22 wherein there is a plurality of said cutter units positioned at said operating surface at different circumferential axes.

24. The assembly as recited in claim 22, wherein said secondary trailing cutter has a lowermost cutting edge portion which is at a depth location no higher than the lowermost cutting edge portion of the trailing cutter, relative to an operational depth dimension line of the trailing cutter.

25. The assembly as recited in claim 22, wherein the lowermost cutting edge portion of the secondary trailing edge cutter is at a lower depth relative to an operational depth dimension line of the lowermost edge of the trailing cutter.

26. The assembly as recited in claim 22, wherein the lowermost cutting edge portion of the secondary trailing cutter is at approximately the same depth location, relative to an axial depth dimension reference line as the lowermost cutting edge portion of the trailing cutter, and said secondary trailing cutter is circumferentially closer to said trailing cutter measured in a forward direction of travel to said trailing cutter, in comparison to a circumferential distance measured in a rearward direction of travel circumferentially to said trailing cutter.

27. The assembly as recited in claim 22, wherein there is at least one additional secondary trailing cutter which has a cutting edge and which is positioned on said circumferential axis rearwardly of said secondary trailing cutter, said additional secondary trailing cutter having an operational depth location, relative to an operational depth dimension reference line, no higher than the operational depth location of the trailing cutter.

28. The assembly as recited in claim 27, wherein said lowermost cutting edge portion of the additional secondary edge cutter is at a depth location, relative to an operational depth dimension line of the secondary trailing cutter, lower than the lowermost edge of the secondary trailing cutter.

29. The assembly as recited in claim 28, wherein the lowermost cutting edge portion of the additional secondary trailing cutter is at least as low as approximately the same depth location, relative to an axial depth dimension reference line, as the lowermost cutting edge portion of the secondary trailing cutter.

30. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis; said cutter unit comprising:

i. a forwardly located lead positioning cutter having at a lower end thereof a lower relatively hard positioning portion having a downwardly facing relatively blunt contact surface, which contact surface is located axially at a lower positioning location at a lower end of said positioning cutter to engage material at the drill hole end wall at said circumferential path;

ii. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

c. said assembly being arranged in a manner that said cutter unit travels axially in a generally helical path having a helical axis, as the drill bit assembly, in operation, rotates and travels downwardly as said drill bit assembly removes material from the end wall of the drill hole;

d. said assembly having an operational depth dimension reference line, measured at angularly spaced locations around a circumferential axis of said helical path relative to axial distance from said helical path;

e. said assembly having an axial depth dimension reference line measured relative to locations on the drill bit assembly along a plane that is fixedly located at an axial location on the drill bit assembly perpendicular to the longitudinal axis;

f. said trailing cutter having a lowermost cutting edge portion which is lower, relative to the operational depth dimension line, than a lowermost portion of the contact surface of the positioning cutter;

g. a liquid jet cutter positioned on said circumferential axis between said positioning cutter and said trailing cutter, said liquid jet cutter being arranged to direct a high velocity liquid jet downwardly against said end wall at a location forwardly of said trailing cutter, whereby, in operation, said lead positioning cutter engages the drill hole end wall to locate the drill bit assembly axially relative to the end wall of the drill hole, and thus locate the cutting depth of the trailing cutter axially relative to the circumferential path.

31. The assembly as recited in claim 30, wherein there is a plurality of said cutter units positioned at said operating surface at different circumferential axes.

32. The assembly as recited in claim 30, wherein a lowermost surface portion of a lower surface of said liquid jet cutter is positioned at a depth location above the lowermost portion of the contact surface of the positioning cutter with reference to the axial depth dimension reference line.

33. The assembly as recited in claim 32, wherein said liquid jet cutter has a wear resistant material at said lower surface of the liquid jet cutter, the lower surface of the liquid jet cutter slanting away from a liquid jet discharge nozzle at an upward slant, whereby a splash back resulting from said liquid jet is deflected away from the liquid discharge nozzle.

34. The assembly as recited in claim 33, wherein there is a plurality of said cutter units mounted at the operating surface of the drill bit housing, and said operating surface of the drill bit housing is positioned above lowermost portions of said positioning cutter, said liquid jet cutter, and said trailing cutter, in a manner to provide a liquid flow passage means between said drill hole end wall and said operating surface whereby liquid flow from the liquid jet cutters of the cutter units is able to pass from said operating surface and around said drill bit housing.

35. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis; said cutter unit comprising:

i. a forwardly located lead positioning cutter having at a lower end thereof a lower relatively hard positioning portion having a downwardly facing relatively blunt contact surface, which contact surface is located axially at a lower positioning location at the lower end of said positioning cutter to engage material at the drill hole end wall at said circumferential path;

ii. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

iii. a liquid jet cutter positioned on said circumferential axis between said positioning cutter and said trailing cutter, said liquid jet cutter being arranged to direct a high velocity liquid jet downwardly against said end wall at a location forwardly of said trailing cutter, whereby, in operation, said lead positioning cutter engages the drill hole end wall to locate the drill bit assembly axially relative to the end wall of the drill hole, and thus locate the cutting depth of the trailing cutter axially relative to the circumferential path.

36. The assembly as recited in claim 35, wherein a lowermost surface portion of a lower surface of said liquid jet cutter is positioned at a depth location above the lowermost portion the contact surface of the positioning cutter with reference to an axial depth dimension reference line.

37. The assembly as recited in claim 36, wherein said liquid jet cutter has a wear resistant material at said lower surface of the liquid jet cutter, the lower surface of the liquid jet cutter slanting away from a liquid jet discharge nozzle at an upwardly slant, whereby a splash back resulting from said liquid jet is deflected away from the liquid discharge nozzle.

38. The assembly as recited in claim 37, wherein there is a plurality of said cutter units mounted at the operating surface of the drill bit housing, and said operating surface of the drill bit housing is positioned above lowermost portions of said positioning cutter, said liquid jet cutter, and said trailing cutter, in a manner to provide a liquid flow passage means between said hole end wall and said operating surface whereby liquid flow from the liquid jet cutters of the cutter units is able to pass from said operating surface and around said drill bit housing.

39. The assembly as recited in claim 35, wherein said cutter unit comprises a secondary trailing cutter which has a cutting edge and is positioned on said circumferential axis rearwardly of said trailing cutter, which is a primary cutter.

40. The assembly as recited in claim 39, wherein there is a plurality of said cutter units positioned at said operating surface at different circumferential axes.

41. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis; said cutter unit comprising:

i. a forwardly located lead primary cutter having a cutting edge with a lowermost cutting edge portion located axially at a lower location at the circumferential path;

ii. a trailing secondary cutter having a cutting edge with a lowermost cutting edge portion, said secondary cutter being positioned at said circumferential axis rearwardly of said lead primary cutter;

iii. a liquid jet cutter positioned on said circumferential axis behind said trailing cutter, said liquid jet cutter being arranged to direct a high velocity liquid jet downwardly against said end wall at a location rearwardly of said trailing cutter;

c. said cutter unit being arranged to travel axially in a generally helical path having a helical axis, as the drill bit assembly, in operation, rotates and travels downwardly as said drill bit assembly removes material from the end wall of the drill hole;

d. said lead cutter having a lead cutter operational depth dimension reference line, which is coincident with a helical path traveled by said lead cutter, and with location from said lead cutter operational depth dimension lines being measured at angularly spaced locations around said operational depth dimension reference line;

e. said lead cutter having an axial depth dimension reference line measured relative to locations from a plane that is located at a fixed axial location on the drill bit assembly perpendicular to the longitudinal axis, and passing through the lowermost edge portion of the lead cutter;

f. the trailing cutter being positioned relative to the lead cutter so that the distance of the lowermost edge portion of the trailing cutter is above a depth location of below said operational depth dimension reference line of the lead cutter by a distance of one half the axial distance that the cutter unit travels in one revolution, whereby said lead cutter cuts to a greater material depth along said circumferential path than said trailing cutter.

42. The assembly as recited in claim 41, wherein a lowermost surface portion of a lower surface of said liquid jet cutter is positioned at a depth location above the lowermost portion of the cutting edge portion of the lead cutter with reference to the operational depth dimension reference line.

43. A method of drilling into an earth formation to form a drill hole having a hole side wall and a hole end wall, said method comprising:

a. providing a rotary drill bit assembly having a longitudinal axis of rotation, with said drill bit assembly comprising:

i. a drill bit housing having an upper end adapted to be connected to a drill string means and a lower end at which the housing has an operating surface, said housing being configured and arranged for rotation about said longitudinal axis;

ii. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis, said cutter unit comprising:

1. a forwardly located lead positioning cutter having at a lower end thereof a lower relatively hard positioning portion having a downwardly facing relatively blunt contact surface, which contact surface is located axially at a lower positioning location at the lower end of said positioning cutter to engage material at the drill hole end wall at said circumferential path;

2. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

3. a secondary trailing cutter which has a cutting edge, positioned on said circumferential axis rearwardly of said trailing cutter, and positioning a lowermost cutting edge portion of said secondary trailing cutter at a depth location no higher than the lowermost cutting edge portion of the trailing cutter, relative to an operational depth dimension line of the trailing cutter, b. rotating said drill bit assembly with an axial downward force exerted by said drill bit assembly against said end wall, in a manner that said lead positioning cutter engages the drill hole end wall to locate the drill bit assembly axially relative to the end wall of the drill hole, and thus locate the cutting depth of the trailing cutter axially relative to the circumferential path.

44. The method as recited in claim 43, comprising providing said positioning cutter with a relatively hard material removal surface portion of said contact surface extending forwardly and upwardly from a lowermost positioning surface portion of said contact surface, and causing said positioning cutter to engage and remove at least some material from said drill hole end wall, and to ride upwardly and over a relatively hard obstruction in said earth formation.

45. The method as recited in claim 43, wherein the lowermost cutting edge portion of the secondary edge cutter is at a lower depth, relative to the operational depth dimension line of the trailing cutter, than the lowermost edge of the trailing cutter.

46. The method as recited in claim 43, wherein the lowermost cutting edge portion of the secondary trailing cutter is at approximately the same depth location, relative to an axial depth dimension reference line, as the lowermost cutting edge portion of the trailing cutter, and said secondary trailing cutter is circumferentially closer to said trailing cutter measured in a forward direction of travel to said trailing cutter, in comparison to a circumferential distance measured in a rearward direction of travel circumferentially to said trailing cutter.

47. A rotary drill bit assembly having a longitudinal axis of rotation, said drill bit assembly being adapted to drill into an earth formation to form a drill hole having a hole side wall and a hole end wall, said assembly comprising:

a. a drill bit housing having an upper end adapted to be connected to a drill string means and a lower end at which the housing has an operating surface, said housing being configured and arranged for rotation about said longitudinal axis;

b. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis; said cutter unit comprising:

i. a forwardly located lead positioning cutter having a lower relatively hard positioning portion having a downwardly facing relatively blunt contact surface, which contact surface is located axially at a lower positioning location to engage material at the drill hole end wall at said circumferential path;

ii. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

iii. a secondary trailing cutter which has a cutting edge and is positioned on said circumferential axis rearwardly of said trailing cutter, which is a primary cutter, c. said cutter unit being arranged to travel axially in a generally helical path having a helical axis, as the drill bit assembly, in operation, rotates and travels downwardly as said drill bit assembly removes material from the end wall of the drill hole;

d. said assembly having an operational depth dimension reference line, measured at angularly spaced locations around a circumferential axis of said helical path relative to axial distance from said helical path;

e. said assembly having an axial depth dimension reference line measured relative to locations on the drill bit assembly along a plane that is fixedly located at an axial location on the drill bit assembly perpendicular to the longitudinal axis;

f. said trailing cutter having a lowermost cutting edge portion which is lower, relative to the operational depth dimension line, than a lowermost portion of the contact surface of the positioning cutter, whereby, in operation, said lead positioning cutter engages the drill hole end wall to locate the drill bit assembly axially relative to the end wall of the drill hole, and thus locate the cutting depth of the trailing cutter axially relative to the circumferential path.

48. The assembly as recited in claim 47 wherein there is a plurality of said cutter units positioned at said operating surface at different circumferential axes.

49. The assembly as recited in claim 47, wherein said secondary trailing cutter has a lowermost cutting edge portion which is at a depth location no higher than the lowermost cutting edge portion of the trailing cutter, relative to the operational depth dimension line of the trailing cutter.

50. The assembly as recited in claim 47, wherein the lowermost cutting edge portion of the secondary trailing edge cutter is at a lower depth relative to the operational depth dimension line of the lowermost edge of the trailing cutter.

51. The assembly as recited in claim 47, wherein the lowermost cutting edge portion of the secondary trailing cutter is at approximately the same depth location, relative to the axial depth dimension reference line as the lowermost cutting edge portion of the trailing cutter, and said secondary trailing cutter is circumferentially closer to said trailing cutter measured in a forward direction of travel to said trailing cutter, in comparison to a circumferential distance measured in a rearward direction of travel circumferentially to said trailing cutter.

52. The assembly as recited in claim 47, wherein there is at least one additional secondary trailing cutter which has a cutting edge and which is positioned on said circumferential axis rearwardly of said secondary trailing cutter, said additional secondary trailing cutter having an operational depth location, relative to said operational depth dimension reference line, no higher than the operational depth location of the trailing cutter.

53. The assembly as recited in claim 52, wherein said lowermost cutting edge portion of the additional secondary edge cutter is at a depth location, relative to the operational depth dimension line of the secondary trailing cutter, lower than the lowermost edge of the secondary trailing cutter.

54. The assembly as recited in claim 53, wherein the lowermost cutting edge portion of the additional secondary trailing cutter is at least as low as approximately the same depth location, relative to the axial depth dimension reference line, as the lowermost cutting edge portion of the secondary trailing cutter.

55. A method of drilling into an earth formation to form a drill hole having a hole side wall and a hole end wall, said method comprising:

a. providing a rotary drill bit assembly having a longitudinal axis of rotation, with said drill bit assembly comprising;

i. a drill bit housing having an upper end adapted to be connected to a drill string means and a lower end at which the housing has an operating surface, said housing being configured and arranged for rotation about said longitudinal axis;

ii. at least one cutter unit mounted at said operating surface along a circumferential cutting path having a circumferential axis at a pre-determined radial distance from the longitudinal axis, in a manner that as said drill bit assembly rotates about said longitudinal axis, said cutter unit travels along said circumferential cutting path in a forward direction around said longitudinal axis, said cutter unit comprising:

1. a forwardly located lead positioning cutter having a lower relatively hard positioning portion having a downwardly facing relatively blunt contact surface, which contact surface is located axially at a lower positioning location to engage material at the drill hole end wall at said circumferential path;

2. a trailing cutter having a relatively sharp cutting edge portion which is positioned at said circumferential axis rearwardly of said lead positioning cutter at an axial location operationally lower than the contact surface of the positioning cutter, in a manner to be positioned and configured to cut into said drill hole end wall as said drill assembly advances into the drill hole;

3. a liquid jet cutter positioned on said circumferential axis between said lead positioning cutter and said trailing cutter;

b. rotating said drill bit assembly with an axial downward force exerted by said drill bit assembly against said end wall, in a manner that said lead positioning cutter engages the drill hole end wall to locate the drill bit assembly axially relative to the end wall of the drill hole, and thus locate the cutting depth of the trailing cutter axially relative to the circumferential path, and c. directing a high velocity liquid jet from said liquid jet cutter downwardly against said end wall at a location forwardly of said trailing cutter.

56. The method as recited in claim 55, wherein a lowermost surface portion of a lower surface of said liquid jet cutter is positioned at a depth location above the lowermost portion of the contact surface of the positioning cutter with reference to the axial depth dimension reference line.

57. The method as recited in claim 55, wherein there is a plurality of said cutter units mounted at the operating surface of the drill bit housing, and said operating surface of the drill bit housing is positioned above lowermost portions of said positioning cutter, said method further comprising providing a liquid flow passage means between said drill hole end wall and said operating surface and causing liquid flow from the liquid jet cutters to pass from said operating surface and around said drill bit housing.

* * * * *